US005928393A

United States Patent [19]

Ishida et al.

[11] Patent Number: 5,928,393

[45] Date of Patent: Jul. 27, 1999

[54] FUEL ADDITIVE

[75] Inventors: Noboru Ishida, Yokohama; Katsuhiko Haji, Yokoahma; Masaki Nagao; Toru Yoshii, both of Yokohama, all of Japan

[73] Assignee: Nippon Oil Co., Ltd., Tokyo, Japan

[21] Appl. No.: 08/896,193

[22] Filed: Jul. 17, 1997

[30] Foreign Application Priority Data

| | | | |
|---|---|---|---|
| Jul. 18, 1996 | [JP] | Japan | 8-207789 |
| Jul. 18, 1996 | [JP] | Japan | 8-207790 |
| Aug. 16, 1996 | [JP] | Japan | 8-234763 |

[51] Int. Cl.[6] ..... C10L 1/22

[52] U.S. Cl. ..... 44/387; 558/275; 558/276; 560/60; 560/186; 44/391; 44/399

[58] Field of Search ..... 44/399, 391, 400, 44/418, 387; 558/275, 276; 560/60, 186

[56] References Cited

U.S. PATENT DOCUMENTS

| | | | |
|---|---|---|---|
| 4,160,648 | 7/1979 | Lewis et al. | 44/387 |
| 4,247,301 | 1/1981 | Honnen | 44/334 |
| 5,211,721 | 5/1993 | Sung et al. | 44/389 |
| 5,306,314 | 4/1994 | Cherpeck | 44/387 |
| 5,352,251 | 10/1994 | Lin et al. | 44/340 |
| 5,458,661 | 10/1995 | Lin et al. | 44/418 |
| 5,637,120 | 6/1997 | Cherpeck | 44/387 |

FOREIGN PATENT DOCUMENTS 2 407 258 5/1979 France .

OTHER PUBLICATIONS

European Search Report for corresponding European Application No. 97850116.1–2104 (Nov. 26, 1997), 3 pages.

*Primary Examiner*—Ellen M. McAvoy
*Attorney, Agent, or Firm*—Panitch Schwarze Jacobs & Nadel, P.C.

[57] ABSTRACT

A fuel additive which comprises a compound selected from a novel amine, oxygen-containing and nitrogen-containing compounds having selected structures. The inventive additive when blended with a gasoline serves to suppress sludge or deposits in fuel intake systems or combustion chambers for example of an automobile engine.

5 Claims, No Drawings

FUEL ADDITIVE

BACKGROUND OF THE INVENTION

1. Field of the Invention

This invention relates to fuel additives and fuel compositions incorporating such additives.

2. Prior Art

Sludge or other objectionable deposits if formed in internal combustion engine fuel systems or combustion chambers of automobiles are responsible for engine trouble or abnormal rise in carbon monoxide, oxides of nitrogen and unburnt hydrocarbon concentrations in the exhaust gases. It has thus far been proposed to use certain fuel additives, typically a gasoline detergent such as a polyether amine-based or polyolefin-based detergent for removing or otherwise preventing deposits in the carburetor, electronic fuel injections, intake valves and other internal operative parts of the automobile. Additives to this end are disclosed in U.S. Pat. Nos. 4,247,301 and 4,160,648 wherein a polyether-based gasoline detergent dispersant is recited as effective in removing or controlling deposits particularly on the fuel intake system.

Intensive research efforts have been made in the automobile industry to eliminate or alleviate the adverse effect of exhaust gases upon the human body and the environment is parallel with the effort for fuel consumption reduction. With this background in view, there has been a growing demand for more effective and advantageous gasoline additives such that may serve to maintain cleanliness of fuel intake systems and combustion chambers particularly when the engine is under cool conditions.

It has now been found that amine, oxygen-containing or nitrogen-containing compounds of a selected structure can exhibit surprisingly high deterging performance when blended with gasoline fuels.

SUMMARY OF THE INVENTION

The present invention seeks to provide a novel fuel additive which is in itself highly resistant to sludge or deposit formation and which has excellent detergent capabilities.

The invention further seeks to provide a fuel composition which incorporates such a novel additive.

According to one aspect of the invention, there is provided a fuel additive which comprises a compound selected from the group consisting of (A) an amine compound, (B) an oxygen-containing compound and (C) a nitrogen-containing compound:

said amine compound (A) being represented by (I)

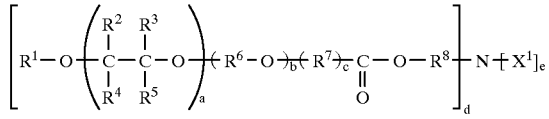

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of formula (II) below, provided that at least one of $R^2$, $R^3$, $R^4$ and $R^5$ is a group of formula (II), $R^6$ is a $C_2$–$C_6$ alkylene group, $R^7$ and $R^8$ each are a $C_1$–$C_6$ alkylene group, a is an integer of between 1 to 100, b is an integer of between 0 to 100, the sum of a and b being equal to between 1 to 200, c is an integer of 0 or 1, d and e each are an integer of 1 or 2, the sum of d and e being equal to 3, and if e is equal to 1, $X^1$ is a group of formula (III) below and if e is equal to 2, one of $X^1$ is a group of formula (III) below and the other is a $C_1$–$C_{30}$ hydrocarbon group or a group of formula (III), said formula (II) being represented by (II)

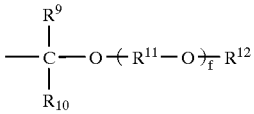

wherein $R^9$ and $R^{10}$ each are hydrogen, a $C_1$–$C_{10}$ hydrocarbon group or a $C_2$–$C_{10}$ alkoxyalkyl group, $R^{11}$ is a $C_2$–$C_6$ alkylene group or a $C_4$–$C_{10}$ alkylene group having an alkoxyalkyl substituent, $R^{12}$ is hydrogen or a $C_1$–$C_{30}$ hydrocarbon group, and f is an integer of between 0 to 50;

said formula (III) being represented by $$—R^{13}—OH \quad \text{(III)}$$

wherein $R^{13}$ is a $C_1$–$C_6$ alkylene group;

said oxygen-containing compound (B) being represented by (IV)

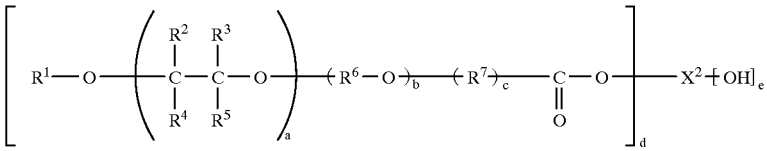

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of said formula (II) above, provided that at least one of $R^2$, $R^3$, $R^4$ and $R^5$ is a group of said formula (II), $R^6$ is a $C_2$–$C_6$ alkylene group, $R^7$ is a $C_1$–$C_6$ alkylene group, a is an integer of between 1 to 100, b is an integer of between 0 to 100, the sum of a and b being equal to between 1 to 200, c is an integer of 0 or 1, d is an integer of between 1 to 19, e is an integer of between 1 to 19, the sum of d and e is equal to between 2 to 20 and $X^2$ is the residual group of a nitrogen-free polyhydric alcohol having 2–20 hydroxyl groups; and said nitrogen-containing (C) compound being represented by (V)

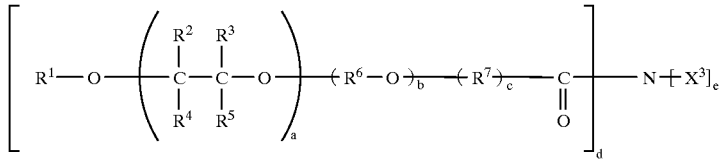

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of said formula (II) above, provided that at least one of $R^2$, $R^3$, $R^4$ and $R^5$ is a group of said formula (II), $R^6$ is a $C_2$–$C_6$ alkylene group, $R^7$ is a $C_1$–$C_6$ alkylene group, a is an integer of between 1 to 100, b is an integer of between 0 to 100, the sum of a and b being equal to between 1 to 200, c is an integer of 0 or 1, d and e each are an integer of 1 or 2, the sum of d and e being equal to 3, and if e is equal to 1, $X^3$ is an organic residual group having at least one hydroxyl group and if e is equal to 2, 1) one of $X^3$ is an organic residual group having at least one hydroxyl group and the other is selected from the group consisting of an organic residual group having at least one hydroxyl group, hydrogen and a $C_1$–$C_{30}$ hydrocarbon group or 2) $X^3$ represents a heterocyclic ring containing the nitrogen atom in formula (V) joined therein and having at least one hydroxyl group.

According to another aspect of the invention, there is provided a fuel composition which comprises a base gasoline blended with a compound selected from the group consisting of (A) an amine compound, (B) an oxygen-containing compound and (C) a nitrogen-containing compound:

said amine compound (A) being represented by (I)

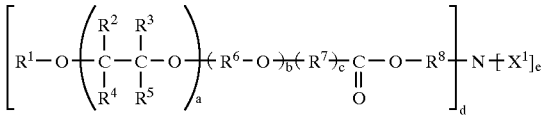

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of formula (II) below, provided that at least one of $R^2$, $R^3$, $R^4$ and $R^5$ is a group of formula (II), $R^6$ is a $C_2$–$C_6$ alkylene group, $R^7$ and $R^8$ each are a $C_1$–$C_6$ alkylene group, a is an integer of between 1 to 100, b is an integer of between 0 to 100, the sum of a and b being equal to between 1 to 200, c is an integer of 0 or 1, d and e each are an integer of 1 or 2, the sum of d and e being equal to 3, if e is equal to 1, $X^1$ is a group of formula (III) below and if e is equal to 2, one of $X^1$ is a group of formula (III) below and the other is a $C_1$–$C_{30}$ hydrocarbon group or a group of formula (III), said formula (II) being represented by (II)

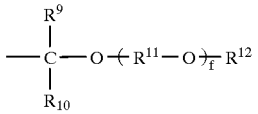

wherein $R^9$ and $R^{10}$ each are hydrogen, a $C_1$–$C_{10}$ hydrocarbon group or a $C_2$–$C_{10}$ alkoxyalkyl group, $R^{11}$ is a $C_2$–$C_6$ alkylene group or a $C_4$–$C_{10}$ alkylene group having an alkoxyalkyl substituent, $R^{12}$ is hydrogen or a $C_1$–$C_{30}$ hydrocarbon group, and f is an integer of between 0 to 50;

said formula (III) being represented by $$—R^{13}—OH \quad \text{(III)}$$

wherein $R^{13}$ is a $C_1$–$C_6$ alkylene group;

said oxygen-containing compound (B) being represented by (IV)

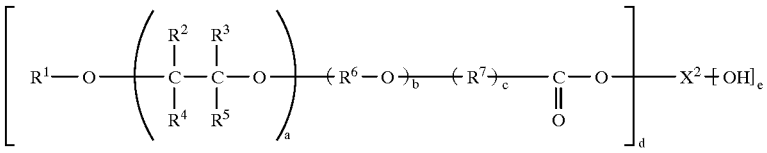

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of said formula (II) above, provided that at least one of $R^2$, $R^3$, $R^4$ and $R^5$ is a group of said formula (II), $R^6$ is a $C_2$–$C_6$ alkylene group, $R^7$ is a $C_1$–$C_6$ alkylene group, a is an integer of between 1 to 100, b is an integer of between 0 to 100, the sum of a and b being equal to between 1 to 200, c is an integer of 0 or 1, d is an integer of between 1 to 19, e is an integer of between 1 to 19, the sum of d and e is equal to between 2 to 20 and $X^2$ is the residual group of nitrogen-free polyhydric alcohol having 2–20 hydroxyl groups; and said nitrogen-containing (C) compound being represented by (V)

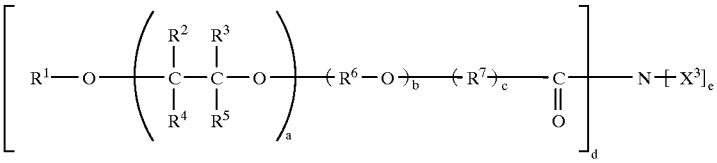

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of said formula (II) above, provided that at least one of $R^2$, $R^3$, $R^4$ and $R^5$ is a group of said formula (II), $R^6$ is a $C_2$–$C_6$ alkylene group, $R^7$ is a $C_1$–$C_6$ alkylene group, a is an integer of between 1 to 100, b is an integer of between 0 to 100, the sum of a and b being equal to between 1 to 200, c is an integer of 0 or 1, d and e each are an integer of 1 or 2, the sum of d and e is equal to 3, and if e is equal to 1, $X^3$ is an organic residual group having at least one hydroxyl group and if e is equal to 2, 1) one of $X^3$ is an organic residual group having at least one hydroxyl group and the other is selected from the group consisting of an organic residual group having at least one hydroxyl group, hydrogen and a $C_1$–$C_{30}$ hydrocarbon group or 2) $X^3$ represents a heterocyclic ring containing the nitrogen atom in formula (V) joined therein and having at least one hydroxyl group.

DETAILED DESCRIPTION OF THE INVENTION

The above and other features and advantages of the invention will be better understood from the following detailed description.

The term oil as used herein generally designates liquid hydrocarbons boiling in the range of between 30° C. and 700° C., preferably 40° C. and 600° C. primarily intended for combustion and derivable from petroleum, wastes, oil shale, oil sand, coal, biomass. However, the liquid hydrocarbons containing crude oil or petroleum fractions as main component should be used. The crude oil includes paraffin-based crude oil, naphthene-based crude oil, mixed crude oil, special crude oil and mixtures thereof. The petroleum fractions include fractions or residues derived from distillation, cracking and reformation of the crude oil and its mixtures and specifically encompass gasoline fractions for automobile engines and various internal combustion engines for agricultural or forestry use, naphtha fractions (light, heavy and whole-range), jet fuel, aviation gasoline, kerosine fractions for air-conditioning, cooking, motor drive, industry and the like, gas oil fractions for diesel engines and heating fuels, heavy oil fractions (A, B and C) for boilers, heating systems in buildings, marine diesel engines and ceramics, and mixtures thereof.

The term wastes includes city and industrial wastes and spent oils that may be recycled into useful liquid hydrocarbon fuels.

The inventive amine, oxygen-containing or nitrogen-containing compound finds advantageous use as an additive to gasolines (such as automobile gasolines of JIS K 2202) for internal combustion engines in particular as it exhibits prominent deterging ability to maintain cleanliness of fuel intake systems and combustion chambers.

A fuel additive which comprises a compound selected from the group consisting of (A) an amine compound, (B) an oxygen-containing compound and (C) a nitrogen-containing compound:

said amine compound (A) being represented by (I)

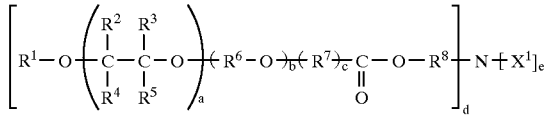

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of formula (II) below, provided that at least one of $R^2$, $R^3$, $R^4$ and $R^5$ is a group of formula (II), $R^6$ is a $C_2$–$C_6$ alkylene group, $R^7$ and $R^8$ each are a $C_1$–$C_6$ alkylene group, a is an integer of between 1 to 100, b is an integer of between 0 to 100, the sum of a and b being equal to between 1 to 200, c is an integer of 0 or 1, d and e each are an integer of 1 or 2, the sum of d and e being equal to 3, and if e is equal to 1, $X^1$ is a group of formula (III) below and if e is equal to 2, one of $X^1$ is a group of formula (III) below and the other is a $C_1$–$C_{30}$ hydrocarbon group or a group of formula (III), said formula (II) being represented by (II)

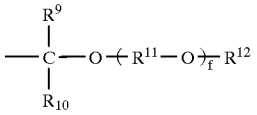

wherein $R^9$ and $R^{10}$ each are hydrogen, a $C_1$–$C_{10}$ hydrocarbon group or a $C_2$–$C_{10}$ alkoxyalkyl group, $R^{11}$ is a $C_2$–$C_6$ alkylene group or a $C_4$–$C_{10}$ alkylene group having an alkoxyalkyl substituent, $R^{12}$ is hydrogen or a $C_1$–$C_{30}$ hydrocarbon group, and f is an integer of between 0 to 50;

said formula (III) being represented by $$—R^{13}—OH \quad \text{(III)}$$

wherein $R^{13}$ is a $C_1$–$C_6$ alkylene group;

said oxygen-containing compound (B) being represented by (IV)

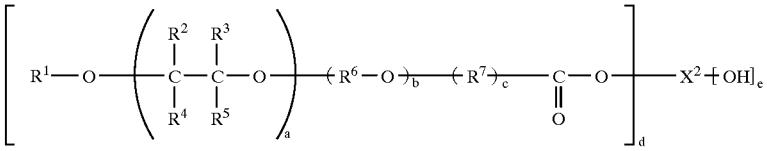

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of said formula (II) above, provided that at least one of $R^2$, $R^3$, $R^4$ and $R^5$ is a group of said formula (II), $R^6$ is a $C_2$–$C_6$ alkylene group, $R^7$ is a $C_1$–$C_6$ alkylene group, a is an integer of between 1 to 100, b is an integer of between 0 to 100, the sum of a and b being equal to between 1 to 200, c is an integer of 0 or 1, d is an integer of between 1 to 19, e is an integer of between 1 to 19, the sum of d and e is equal to between 2 to 20 and $X^2$ is the residual group of a nitrogen-free polyhydric alcohol having 2–20 hydroxyl groups; and said nitrogen-containing (C) compound being represented by (V)

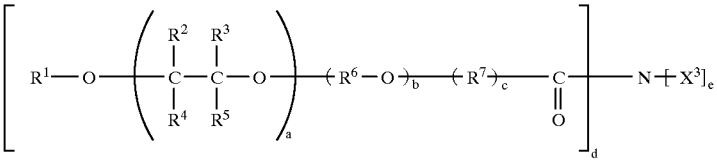

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of said formula (II) above, provided that at least one of $R^2$, $R^3$, $R^4$ and $R^5$ is a group of said formula (II), $R^6$ is a $C_2$–$C_6$ alkylene group, $R^7$ is a $C_1$–$C_6$ alkylene group, a is an integer of between 1 to 100, b is an integer of between 0 to 100, the sum of a and b being equal to between 1 to 200, c is an integer of 0 or 1, d and e each are an integer of 1 or 2, the sum of d and e being equal to 3, and if e is equal to 1, $X^3$ is an organic residual group having at least one hydroxyl group and if e is equal to 2, 1) one of $X^3$ is an organic residual group having at least one hydroxyl group and the other is selected from the group consisting of an organic residual group having at least one hydroxyl group, hydrogen and a $C_1$–$C_{30}$ hydrocarbon group or 2) $X^3$ represents a heterocyclic ring containing the nitrogen atom in formula (V) joined therein and having at least one hydroxyl group.

Each of the inventive compounds is described in detail herein below.

Amine compound

In formula (I) representing the amine compound of the invention, $R^1$ is preferably hydrogen, a $C_1$–$C_{24}$ straight or branched alkyl group, a $C_2$–$C_{24}$ straight or branched alkenyl group, a $C_5$–$C_{13}$ cycloalkyl or alkylcycloalkyl group, a $C_6$–$C_{18}$ aryl or alkylaryl group, or a $C_7$–$C_{19}$ arylalkyl group.

Preferred examples of alkyl group $R^1$ include methyl, ethyl, n-propyl, isopropyl, n-butyl, isobutyl, sec-butyl, tert-butyl, straight or branched pentyl, straight or branched hexyl,straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched icosyl, straight or branched henicosyl, straight or branched docosyl, straight or branched tricosyl and straight or branched tetracosyl.

Preferred examples of alkenyl group $R^1$ include vinyl, propenyl, isopropenyl, straight or branched butenyl, butadienyl, straight or branched pentenyl, straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl such as oleyl, straight or branched nonadecenyl, straight or branched icosenyl, straight or branched henicosenyl, straight or branched docosenyl, straight or branched tricosenyl and straight or branched tetracosenyl.

Preferred examples of cycloalkyl group $R^1$ include cyclopentyl, cyclohexyl and cycloheptyl, and alkylcycloalkyl group $R^1$ include methylcyclopentyl inclusive of all isomers, dimethylcyclopentyl (inclusive of all isomers), ethylcyclopentyl (inclusive of all isomers), straight or branched propylcyclopentyl (inclusive of all isomers), ethylmethylcyclopentyl (inclusive of all isomers), trimethylcyclopentyl (inclusive of all isomers), diethylcyclopentyl (inclusive of all isomers), ethyldimethylcyclopentyl (inclusive of all isomers), straight or branched propylmethylcyclopentyl (inclusive of all isomers), straight or branched propylethylcyclopentyl (inclusive of all isomers), di-straight or branched propylcyclopentyl (inclusive of all isomers), straight or branched propylethylmethylcyclopentyl (inclusive of all isomers), methylcyclohexyl (inclusive of all isomers), dimethylcyclohexyl (inclusive of all isomers), ethylcyclohexyl (inclusive of all isomers), straight or branched propylcyclohexyl (inclusive of all isomers), ethylmethylcyclohexyl (inclusive of all isomers), trimethylcyclohexyl (inclusive of all isomers), diethylcyclohexyl (inclusive of all isomers), ethyldimethylcyclohexyl (inclusive of all isomers), straight or branched propylmethylcyclohexyl (inclusive of all isomers), straight or branched propylethylcyclohexyl (inclusive of all isomers), di-straight or branched propylcyclohexyl (inclusive of all isomers), straight or branched propylethylmethylcyclohexyl (inclusive of all isomers), methylcycloheptyl (inclusive of all isomers), dimethycycloheptyl (inclusive of all isomers), ethylcycloheptyl (inclusive of all isomers), straight or branched propylcycloheptyl (inclusive of all isomers), ethylmethylcycloheptyl (inclusive of all isomers), trimethylcycloheptyl (inclusive of all isomers), diethylcycloheptyl (inclusive of all isomers), ethyldimethylcycloheptyl (inclusive of all isomers), straight or branched propylmethylcycloheptyl (inclusive of all isomers), straight or branched propylethylcycloheptyl (inclusive of all isomers), di-straight or branched propylcycloheptyl (inclusive of all isomers) and straight or branched propylethylmethylcycloheptyl (inclusive of all isomers).

Preferred examples of aryl group $R^1$ include phenyl and naphthyl, and alkylaryl group $R^1$ include tolyl (inclusive of all isomers), xylyl (inclusive of all isomers), ethylphenyl (inclusive of all isomers), straight or branched propylphenyl (inclusive of all isomers), ethylmethylphenyl (inclusive of all isomers), trimethylphenyl (inclusive of all isomers), straight or branched butylphenyl (inclusive of all isomers), straight or branched propylmethylphenyl (inclusive of all isomers), diethylphenyl (inclusive of all isomers), ethyldimethylphenyl (inclusive of all isomers), tetramethylphenyl (inclusive of all isomers), straight or branched pentylphenyl (inclusive of all isomers), straight or branched hexylphenyl (inclusive of all isomers), straight or branched heptylphenyl (inclusive of all isomers), straight or branched octylphenyl (inclusive of all isomers), straight or branched nonylphenyl (inclusive of all isomers), straight or branched decylphenyl (inclusive of all isomers), straight or branched undecylphenyl (inclusive of all isomers) and straight or branched dodecylphenyl (inclusive of all isomers), and further arylalkyl group $R^1$ include benzyl, methylbenzyl (inclusive of all isomers), dimethylbenzyl (inclusive of all isomers), phenethyl, methylphenethyl (inclusive of all isomers) and dimethylphenethyl (inclusive of all isomers).

Particularly preferred $R^1$ examples are a $C_1$–$C_{12}$ straight or branched alkyl group and a $C_6$–$C_{18}$ aryl or alkylaryl group, and more preferably a $C_1$–$C_6$ straight or branched alkyl group or phenyl group and a $C_7$–$C_{15}$ straight or branched alkylaryl group.

$R^2$, $R^3$, $R^4$ and $R^5$ each in formula (I) are hydrogen, a $C_1$–$C_{10}$ hydrocarbon or a group of the formula (II). Such a $C_1$–$C_{10}$ hydrocarbon group encompasses a $C_1$–$C_{10}$ straight or branched alkyl group, a $C_2$–$C_{10}$ straight or branched alkenyl group, a $C_5$–$C_{10}$ cycloalkyl or alkylcycloalkyl group, a $C_6$–$C_{10}$ aryl or alkylaryl group and a $C_7$–$C_{10}$ arylalkyl group. Preferred examples of alkyl group include methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl and straight or branched decyl, and alkenyl group include vinyl, propenyl, isopropenyl, straight or branched butenyl, butadienyl, straight or branched pentenyl, straight or branched hexenyl, straight or branched heptenyl, straight or branched octenyl, straight or branched nonenyl and straight or branched decenyl.

Preferred examples of cycloalkyl group include cyclopentyl, cyclohexyl and cycloheptyl, and alkylcycloalkyl group include methylcyclopentyl (inclusive of all isomers), dimethylcyclopentyl (inclusive of all isomers), ethylcyclopentyl (inclusive of all isomers), straight or branched propylcyclopentyl (inclusive of all isomers), ethylmethylcyclopentyl (inclusive of all isomers), trimethylcyclopentyl (inclusive of all isomers), diethylcyclopentyl (inclusive of all isomers), ethyldimethylcyclopentyl (inclusive of all isomers), straight or branched propylmethylcyclopentyl (inclusive of all isomers), straight or branched propylethylcyclopentyl (inclusive of all isomers), methylcyclohexyl (inclusive of all isomers), dimethylcyclohexyl (inclusive of all isomers), ethylcyclohexyl (inclusive of all isomers), straight or branched propylcyclohexyl (inclusive of all isomers), ethylmethylcyclohexyl (inclusive of all isomers), trimethylcyclohexyl (inclusive of all isomers), diethylcyclohexyl (inclusive of all isomers), ethyldimethylcyclohexyl (inclusive of all isomers), straight or branched propylmethylcyclohexyl (inclusive of all isomers), methylcycloheptyl (inclusive of all isomers), dimethylcycloheptyl (inclusive of all isomers), ethylcycloheptyl (inclusive of all isomers), straight or branched propylcycloheptyl (inclusive of all isomers), ethylmethylcycloheptyl (inclusive of all isomers) and trimethylcycloheptyl (inclusive of all isomers).

Preferred examples of aryl group include phenyl and naphthyl, and alkylaryl group include tolyl (inclusive of all isomers), xylyl (inclusive of all isomers), ethylphenyl (inclusive of all isomers), straight or branched propylphenyl (inclusive of all isomers), ethylmethylphenyl (inclusive of all isomers), trimethylphenyl (inclusive of all isomers), straight or branched butylphenyl (inclusive of all isomers), straight or branched propylmethylphenyl (inclusive of all isomers), diethylphenyl (inclusive of all isomers), ethyldimethylphenyl (inclusive of all isomers) and tetramethylphenyl (inclusive of all isomers), and further arylalkyl group include benzyl, methylbenzyl (inclusive of all isomers), dimethylbenzyl (inclusive of all isomers), phenethyl, methylphenethyl (inclusive of all isomers) and dimethylphenethyl (inclusive of all isomers).

Particularly preferred among the above $C_1$–$C_{10}$ hydrocarbon groups is a $C_1$–$C_6$, more preferably $C_1$–$C_3$, straight or branched alkyl group.

At least one of $R^2$–$R^5$ is a group of the formula (II) above wherein $R^9$ and $R^{10}$ each are hydrogen, a $C_1$–$C_{10}$ hydrocarbon group or a $C_2$–$C_{10}$ alkoxyalkyl group. The term $C_1$–$C_{10}$ hydrocarbon group here encompasses all of the groups already identified with regard to $R^2$–$R^5$.

Alcoxyalkyl groups of the formula (II) exemplarily include methoxymethyl, ethoxymethyl, n-propoxymethyl, isopropoxymethyl, n-butoxymethyl, isobutoxymethyl, sec-butoxymethyl, tert-butoxymethyl, pentoxymethyl (inclusive of all isomers), hexoxymethyl (inclusive of all isomers), heptoxymethyl (inclusive of all isomers), octoxymethyl (inclusive of all isomers), nonyloxymethyl (inclusive of all isomers), methoxyethyl (inclusive of all isomers), ethoxyethyl (inclusive of all isomers); propoxyethyl (inclusive of all isomers), butoxyethyl (inclusive of all isomers), pentoxyethyl (inclusive of all isomers), hexoxyethyl (inclusive of all isomers), heptoxyethyl (inclusive of all isomers), octoxyethyl (inclusive of all isomers), methoxypropyl (inclusive of all isomers), ethoxypropyl (inclusive of all isomers), propoxypropyl (inclusive of all isomers), butoxypropyl (inclusive of all isomers), pentoxypropyl (inclusive of all isomers), hexoxypropyl (inclusive of all isomers), heptoxypropyl (inclusive of all isomers), methoxybutyl (inclusive of all isomers), ethoxybutyl (inclusive of all isomers), propoxybutyl (inclusive of all isomers), butoxybutyl (inclusive of all isomers), pentoxybutyl (inclusive of all isomers), hexoxybutyl (inclusive of all isomers), methoxypentyl (inclusive of all isomers), ethoxypentyl (inclusive of all isomers), propoxypentyl (inclusive of all isomers), butoxypentyl (inclusive of all isomers), pentoxypentyl (inclusive of all isomers), methoxyhexyl (inclusive of all isomers), ethoxyhexyl (inclusive of all isomers), propoxyhexyl (inclusive of all isomers), butoxyhexyl (inclusive of all isomers), methoxyheptyl (inclusive of all isomers), ethoxyheptyl (inclusive of all isomers), propoxyheptyl (inclusive of all isomers), methoxyoctyl (inclusive of all isomers), ethoxyoctyl (inclusive of all isomers) and methoxynonyl (inclusive of all isomers).

$R^9$ and $R^{10}$ in formula (II) each are preferably hydrogen, a $C_1$–$C_6$ alkyl group or a $C_2$–$C_6$ alcoxyalkyl group, of which hydrogen and $C_1$–$C_3$ alkyl groups are more preferred.

$R^{11}$ in formula (II) designates a $C_2$–$C_6$ alkylene group or a $C_4$–$C_{10}$ alkylene group having an alkoxyalkyl substituent. The $C_2$–$C_6$ alkylene group exemplarily includes ethylene, 1-methylethylene, 2-methylethylene, trimethylene, butylene (1-ethylethylene, 2-ethylethylene), 1,2-dimethylethylene, 2,2-dimethylethylene, 1-methyltrimethylene, 2-methyltrimethylene, 3-methyltrimethylene, tetramethylene, pentylene (1-butylethylene, 2-butylethylene), 1-ethyl-1-methylethylene, 1-ethyl-2-methylethylene, 1,1,2-trimethylethylene, 1,2,2-trimethylethylene, 1-ethyltrimethylene, 2-ethyltrimethylene, 3-ethyltrimethylene, 1,1-dimethyltrimethylene, 1,2-dimethyltrimethylene, 1,3-dimethyltrimethylene, 2,3-dimethyltrimethylene, 3,3-dimethyltrimethylene, 1-methyltetramethylene, 2-methyltetramethylene, 3-methyltetramethylene, 4-methyltetramethylene, pentamethylene, hexylene (1-butylethylene, 2-butylethylene), 1-methyl-1-propylethylene, 1-methyl-2-propylethylene, 2-methyl-2-propylethylene, 1,1-diethylethylene, 1,2-diethylethylene, 2,2-diethylethylene, 1-ethyl-1,2-dimethylethylene, 1-ethyl-2,2-dimethylethylene, 2-ethyl-1,1-dimethylethylene, 2-ethyl-1,2-dimethylethylene, 1,1,2,2-tetramethylethylene, 1-propyltrimethylene, 2-propyltrimethylene, 3-propyltrimethylene, 1-ethyl-1-methyltrimethylene, 1-ethyl-2-methyltrimethylene, 1-ethyl-3-methyltrimethylene, 2-ethyl-1-methyltrimethylene, 2-ethyl-2-methyltrimethylene, 2-ethyl-3-methyltrimethylene, 3-ethyl-1-methyltrimethylene, 3-ethyl-2-methyltrimethylene, 3-ethyl-3-methyltrimethylene, 1,1,2-trimethyltrimethylene, 1,1,3-trimethyltrimethylene, 1,2,2-trimethyltrimethylene, 1,2,3-trimethyltrimethylene, 1,3,3-trimethyltrimethylene, 2,2,3-trimethyltrimethylene, 2,3,3-trimethyltrimethylene, 1-ethyltetramethylene, 2-ethyltetramethylene, 3-ethyltetramethylene, 4-ethyltetramethylene, 1,1-dimethyltetramethylene, 1,2-dimethyltetramethylene, 1,3-dimethyltetramethylene, 1,4-dimethyltetramethylene, 2,2-dimethyltetramethylene, 2,3-dimethyltetramethylene, 2,4-dimethyltetramethylene, 3,3-dimethyltetramethylene, 3,4-dimethyltetramethylene, 4,4-dimethyltetramethylene, 1-methylpentamethylene, 2-methylpentamethylene, 3-methylpentamethylene, 4-methylpentamethylene, 5-methylpentamethylene and hexamethylene.

The $C_4$–$C_{10}$ alkylene group having an alkoxyalkyl substituent referred to as $R^{11}$ in formula (II) exemplarily includes a $C_2$–$C_8$ alkoxyalkyl substituted ethylene such as
1-(methoxymethyl)ethylene, 2-(methoxymethyl)ethylene,
1-(methoxyethyl)ethylene, 2-(methoxyethyl)ethylene,
1-(ethoxymethyl)ethylene, 2-(ethoxymethyl)ethylene,
1-methoxymethyl-2-methylethylene,
1,1-bis(methoxymethyl)ethylene,
2,2-bis(methoxymethyl)ethylene,
1,2-bis(methoxymethyl)ethylene,
1,1-bis(methoxyethyl)ethylene,
2,2-bis(methoxyethyl)ethylene,
1,2-bis(methoxyethyl)ethylene,
1,1-bis(ethoxymethyl)ethylene,
2,2-bis(ethoxymethyl)ethylene,
1,2-bis(ethoxymethyl)ethylene,
1-methyl-2-methoxymethylethylene,
1-methoxymethyl-2-methylethylene,
1-ethyl-2-methoxymethylethylene,
1-methoxymethyl-2-ethylethylene,
1-methyl-2-ethoxymethylethylene,
1-ethoxymethyl-2-methylethylene,
1-ethyl-2-ethoxymethylethylene,
1-ethoxymethyl-2-ethylethylene,
1-methyl-2-methoxyethylethylene,
1-methoxyethyl-2-methylethylene,
1-ethyl-2-methoxyethylethylene and
1-methoxyethyl-2-ethylethylene.

$R^{11}$ in formula (II) is preferably a $C_2$–$C_4$ alkylene group or a $C_4$–$C_8$ ethylene group substituted with an alkoxyalkylene group.

$R^{12}$ in formula (II) is hydrogen or a $C_1$–$C_{30}$ hydrocarbon group, preferably either of hydrogen or the groups identified with regard to $R^1$ in formula (I), such as a $C_1$–$C_{24}$ alkyl group, a $C_2$–$C_{24}$ alkenyl group, a $C_5$–$C_{13}$ cycloalkyl or alkylcycloalkyl group, a $C_6$–$C_{18}$ aryl or alkylaryl and a $C_7$–$C_{19}$ arylalkyl. Particularly preferred is a $C_1$–$C_{24}$, more preferably $C_1$–$C_{12}$ alkyl group.

The designation f in formula (II) is an integer of between 0 and 50, preferably between 0 and 30, more preferably between 0 and 20.

The group of the formula (II) may be conveniently hereinafter called a "preferred substituent" where $R^9$ and $R^{10}$ each are hydrogen, a $C_1$–$C_6$ alkyl group or a $C_2$–$C_6$ alkoxyalkyl group, $R^{11}$ is a $C_2$–$C_6$ alkylene group or a $C_4$–$C_8$ alkoxyalkyl-substituted ethylene group, $R^{12}$ is a $C_1$–$C_{24}$ alkyl group and f is an integer of between 0 and 30, and a "more preferred substituent" where $R^9$ and $R^{10}$ each are hydrogen or a $C_1$–$C_3$ alkyl group, $R^{11}$ is a $C_2$–$C_4$ alkylene group, $R^{12}$ is a $C_1$–$C_{12}$ alkyl group and f is an integer of between 0 and 20.

Importantly, at least one of $R^2$, $R^3$, $R^4$ and $R^5$ in formula (I) is the group represented by formula (II). Preferably, one or two of $R^2$–$R^5$ groups are the groups of formula (II), while the remaining three or two groups each are hydrogen or a $C_1$–$C_6$ alkyl group. More preferably, one of $R^2$–$R^5$ groups is the above-mentioned "preferred substituent" or "more preferred substituent", while the remaining three each are hydrogen or a $C_1$–$C_3$ alkyl group.

$R^6$ in formula (I) is a $C_2$–$C_6$ alkylene group encompassing ethylene, 1-methylethylene, 2-methylethylene, trimethylene, butylene (1-ethylethylene, 2-ethylethylene), 1,2-dimethylethylene, 2,2-dimethylethylene, 1-methyltrimethylene, 2-methyltrimethylene, 3-methyltrimethylene, tetramethylene, pentylene (1-butylethylene, 2-butylethylene), 1-ethyl-1-methylethylene, 1-ethyl-2-methylethylene, 1,1,2-trimethylethylene, 1,2,2-trimethylethylene, 1-ethyltrimethylene, 2-ethyltrimethylene, 3-ethyltrimethylene, 1,1-dimethyltrimethylene, 1,2-dimethyltrimethylene, 1,3-dimethyltrimethylene, 2,3-dimethyltrimethylene, 3,3-dimethyltrimethylene, 1-methyltetramethylene, 2-methyltetramethylene, 3-methyltetramethylene, 4-methyltetramethylene, pentamethylene, hexylene (1-butylethylene, 2-butylethylene), 1-methyl-1-propylethylene, 1-methyl-2-propylethylene, 2-methyl-2--propylethylene, 1,1-diethylethylene, 1,2-diethylethylene, 2,2-diethylethylene, 1-ethyl-1,2-dimethylethylene, 1-ethyl-2,2-dimethylethylene, 2-ethyl-1,1-dimethylethylene, 2-ethyl-1,2-dimethylethylene, 1,1,2,2-tetramethylethylene, 1-propyltrimethylene, 2-propyltrimethylene, 3-propyltrimethylene, 1-ethyl-1-methyltrimethylene, 1-ethyl-2-methyltrimethylene, 1-ethyl-3-methyltrimethylene, 2-ethyl-1-methyltrimethylene, 2-ethyl-2-methyltrimethylene, 2-ethyl-3-methyltrimethylene, 3-ethyl-1-methyltrimethylene, 3-ethyl-2-methyltrimethylene, 3-ethyl-3-methyltrimethylene, 1,1,2-trimethyltrimethylene, 1,1,3-trimethyltrimethylene, 1,2,2-trimethyltrimethylene, 1,2,3-trimethyltrimethylene, 1,3,3-trimethyltrimethylene, 2,2,3-trimethyltrimethylene, 2,3,3-trimethyltrimethylene, 1-ethyltetramethylene, 2-ethyltetramethylene, 3-ethyltetramethylene, 4-ethyltetramethylene, 1,1-dimethyltetramethylene, 1,2-dimethyltetramethylene, 1,3-dimethyltetramethylene, 1,4-dimethyltetramethylene, 2,2-dimethyltetramethylene, 2,3-dimethyltetramethylene, 2,4-dimethyltetramethylene, 3,3-dimethyltetramethylene, 3,4-dimethyltetramethylene, 4,4-dimethyltetramethylene, 1-methylpentamethylene, 2-methylpentamethylene, 3-methylpentamethylene, 4-methylpentamethylene, 5-methylpentamethylene and hexamethylene.

Particularly preferred is a $C_2$–$C_4$ alkylene group such as ethylene, 1-methylethylene, 2-methylethylene, trimethylene, butylene (1-ethylethylene, 2-ethylethylene), 1,2-dimethylethylene, 2,2-dimethylethylene, 1-methyltrimethylene, 2-methyltrimethylene, 3-methyltrimethylene and tetramethylene.

$R^7$ and $R^8$ in formula (I) each are a $C_1$–$C_6$ alkylene group encompassing methylene, ethylene, 1-methylethylene, 2-methylethylene, trimethylene, butylene (1-ethylethylene, 2-ethylethylene), 1,2-dimethylethylene, 2,2-dimethylethylene, 1-methyltrimethylene, 2-methyltrimethylene, 3-methyltrimethylene, tetramethylene, pentylene (1-butylethylene, 2-butylethylene), 1-ethyl-1-methylethylene, 1-ethyl-2-methylethylene, 1,1,2-trimethylethylene, 1,2,2-trimethylethylene, 1-ethyltrimethylene, 2-ethyltrimethylene, 3-ethyltrimethylene, 1,1-dimethyltrimethylene, 1,2-dimethyltrimethylene, 1,3-dimethyltrimethylene, 2,3-dimethyltrimethylene, 3,3-dimethyltrimethylene, 1-methyltetramethylene, 2-methyltetramethylene, 3-methyltetramethylene, 4-methyltetramethylene, pentamethylene, hexylene (1-butylethylene, 2-butylethylene), 1-methyl-1-propylethylene, 1-methyl-2-propylethylene, 2-methyl-2-propylethylene, 1,1-diethylethylene, 1,2-diethylethylene, 2,2-diethylethylene, 1-ethyl-1,2-dimethylethylene, 1-ethyl-2,2-dimethylethylene, 2-ethyl-1,1-dimethylethylene, 2-ethyl-1,2-dimethylethylene, 1,1,2,2-tetramethylethylene, 1-propyltrimethylene, 2-propyltrimethylene, 3-propyltrimethylene, 1-ethyl-1-methyltrimethylene, 1-ethyl-2-methyltrimethylene, 1-ethyl-3-methyltrimethylene, 2-ethyl-1-methyltrimethylene, 2-ethyl-2-methyltrimethylene, 2-ethyl-3-methyltrimethylene, 3-ethyl-1-methyltrimethylene, 3-ethyl-2-methyltrimethylene, 3-ethyl-3-methyltrimethylene, 1,1,2-trimethyltrimethylene, 1,1,3-trimethyltrimethylene, 1,2,2-trimethyltrimethylene, 1,2,3-trimethyltrimethylene, 1,3,3-trimethyltrimethylene, 2,2,3-trimethyltrimethylene, 2,3,3-trimethyltrimethylene, 1-ethyltetramethylene, 2-ethyltetramethylene, 3-ethyltetramethylene, 4-ethyltetramethylene, 1,1-dimethyltetramethylene, 1,2-dimethyltetramethylene, 1,3-dimethyltetramethylene, 1,4-dimethyltetramethylene, 2,2-dimethyltetramethylene, 2,3-dimethyltetramethylene, 2,4-dimethyltetramethylene, 3,3-dimethyltetramethylene, 3,4-dimethyltetramethylene, 4,4-dimethyltetramethylene, 1-methylpentamethylene, 2-methylpentamethylene, 3-methylpentamethylene, 4-methylpentamethylene, 5-methylpentamethylene and hexamethylene.

Preferred is a $C_1$–$C_4$ alkylene group such as methylene, ethylene, 1-methylethylene, 2-methylethylene, trimethylene, butylene (1-ethylethylene, 2-ethylethylene), 1,2-dimethylethylene, 2,2-dimethylethylene, 1-methyltrimethylene, 2-methyltrimethylene, 3-methyltrimethylene and tetramethylene. Particularly preferred is a $C_1$–$C_3$ alkylene group such as methylene, ethylene, 1-methylethylene, 2-methylethylene and trimethylene.

In formula (I) representing the inventive amine compound, a is an integer of between 1 and 100, preferably between 2 and 50, more preferably between 5 and 50 and b is an integer of between 0 and 100, preferably between 0 and 50, the sum of a and b being equal to between 1 and 200, preferably between 2 and 100, more preferably between 5 and 100.

The inventive amide compound further has a group of the formula (VI)

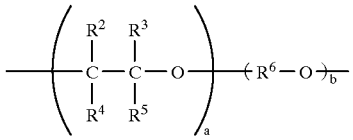

The above group includes 1–100, preferably 2–50, more preferably 5–30 of a constituent unit of the formula (VII)

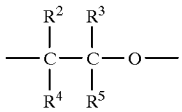

and 0–100, preferably 0–50, more preferably 0–30 of a constituent unit of the formula $$—R^6—O— \quad \text{(VIII)}$$

The sum of constituent units (VII) and (VIII) is between 1 and 200, preferably 2 and 100, more preferably 5 and 100.

$R^2$, $R^3$, $R^4$, $R^5$ and $R^6$, a and b in formula (VI) are the same as indicated in formula (I). $R^2$, $R^3$, $R^4$ and $R^5$ in formula (VII) are the same as indicated in formula (I). $R^6$ in formula (VIII) is the same as indicated in formula (I).

The group represented by formula (VIII) is a group derivable from the following polymers:

(1) Homopolymer consisting of one of the constituent units of formula (VII). (b=0)

(2) Random-, alternating- or block-copolymer consisting of two or more of different constituent units of formula (VII). (b=0)

(3) Random-, alternating- or block-copolymer consisting of one of the constituent units (VII) and one of the constituent units (VIII). (b≠0)

(4) Random-, alternating- or block-copolymer consisting of two or more of different constituent units (VII) and one of the constituent units (VIII). (b≠0)

(5) Random-, alternating- or block-copolymer consisting of one of the constituent units (VII) and two or more of different constituent units (VIII). (b≠0)

(6) Random-, alternating- or block-copolymer consisting of two or more of different constituent units (VII) and two or more of different constituent units (VIII). (b≠0)

In formula (I) the constituent units (VII) and (VIII) are shown bonded to $R^1$—O— group and

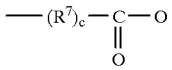

group, respectively. This representation is arbitrary and may be reversed or at random in order.

In formula (I), c is an integer of 0 or 1. If c is equal to 0, the amine compound of formula (I) is indicated by the formula

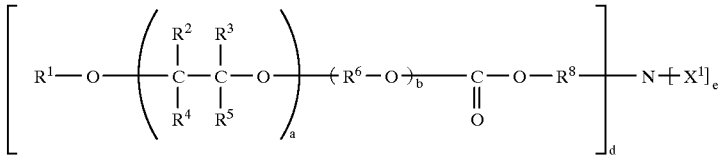

wherein the group represented by the formula (X)

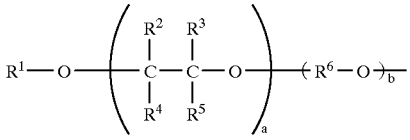

is directly bonded to the carbon atom of carboxyl group.

$R^1$, $R^2$, $R^3$, $R^4$, $R^5$, $R^6$ and $R^8$, and X1 in formula (IX) are the same as indicated in formula (I). Furthermore, a, b, d and e in formula (IX) are the same as indicated in formula (I).

$R^1$, $R^2$, $R^3$, $R^4$, $R^5$ and $R^6$, a and b in formula (X) are the same as indicated in formula (I).

If c is equal to 1, the inventive amine compound is indicated by the formula (XI)

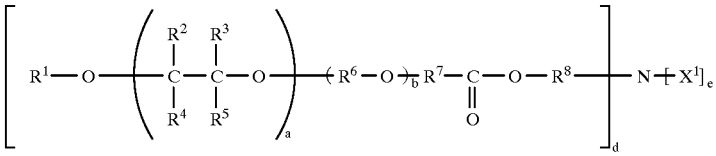

wherein the group of the above formula (X) is bonded through an alkylene group "—$R^7$—" to the carbon atom of carbonyl group.

$R^1$, $R^2$, $R^3$, $R^4$, $R^5$, $R^6$, $R^7$ and $R^8$, and X1, a, b, d and e in formula (XI) are the same as indicated in formula (I).

In formula (I), d and e each are an integer of 1 or 2, preferably 1 and 2 respectively, the sum of d and e being equal to 3.

If d is equal to 2, the inventive amine compound has two groups of the formula (XII)

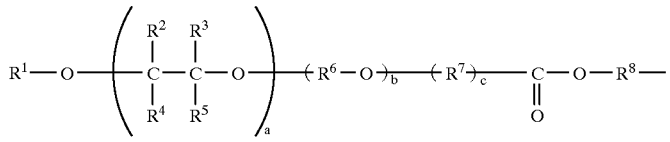

These two groups may be the same or different.

$R^1$, $R^2$, $R^3$, $R^4$, $R^5$, $R^6$, $R^7$ and $R^8$, and a, b and c in formula (XII) are the same as indicated in formula (I).

In formula (I) representing the inventive amine compound, $X^1$ is a group of the formula $$—R^{13}—OH \quad (III)$$

if e is equal to 1 and one of groups $X^1$ is the group of formula (III) and the other is a $C_1$–$C_{30}$ hydrocarbon group or the group of formula (III) if e is equal to 2. However, two $X^1$ being the group of formula (III) are preferred. The $R^{13}$ in formula (III) is a $C_1$–$C_6$ alkylene group including the above-mentioned alkylene group of $R^8$. Preferred is a $C_1$–$C_4$ alkylene group such as methylene, ethylene, 1-methylethylene, 2-methylethylene, trimethylene, butylene (1-ethylethylene, 2-ethylethylene), 1,2-dimethylethylene, 2,2-dimethylethylene, 1-methyltrimethylene, 2-methyltrimethylene, 3-methyltrimethylene and tetramethylene, more preferably ethylene, 1-methylethylene, 2-methylethylene and trimethylene.

Particularly preferred is a $C_1$–$C_3$ alkylene group such as methylene, ethylene, 1-methylethylene, 2-ethylethylene and trimethylene.

The $C_1$–$C_{30}$ hydrocarbon group for group $X^1$ includes the above-mentioned group of $R^1$, such as a $C_1$–$C_{24}$ straight or branched alkyl group, a $C_2$–$C_{24}$ straight or branched alkenyl group, a $C_5$–$C_{13}$ cycloalkyl or alkylcycloalkyl group, a $C_6$–$C_{18}$ aryl or alkylaryl and a $C_7$–$C_{19}$ arylalkyl. Preferred are a $C_1$–$C_{12}$ straight or branched alkyl group or a $C_6$–$C_{12}$ aryl or alkylaryl group. More preferred are a $C_1$–$C_6$ alkyl or phenyl group, and a $C_7$–$C_9$ alkylaryl group.

A typical preferred embodiment of the inventive amine compound having thus been described with respect to the various substituents in formula (I) may be represented in which $R^1$ is a $C_1$–$C_{12}$ straight or branched alkyl group or a $C_6$–$C_{18}$ aryl or alkylaryl group; one or two of the groups of $R^2$, $R^3$, $R^4$ and $R^5$ are the group of formula (II) and the remaining groups each are hydrogen or a $C_1$–$C_6$ alkyl group; $R^9$ and $R^{10}$ each are hydrogen, a $C_1$–$C_6$ alkyl group or a $C_2$–$C_6$ alkoxyalkyl group; $R^{11}$ is a $C_2$–$C_6$ alkylene group or a $C_4$–$C_8$ alkoxyalkyl-substituted ethylene group; $R^{12}$ is a $C_1$–$C_{24}$ alkyl group; f is an integer of between 0 and 30; $R^6$ is a $C_2$–$C_4$ alkylene group; $R^7$ and $R^8$ each are a $C_1$–$C_4$ alkylene group; a is an integer of between 1 and 100 and b is an integer of between 0 and 100, the sum of a and b being between 1 and 200; c is an integer of between 0 and 1 and d is an integer of between 1 and 2, e is an integer of between 1 and 2, the sum of d and e being 3; one of $X^1$ is the group of formula (III) or a $C_1$–$C_{30}$ hydrocarbon group and the other is the group of formula (III) wherein $R^{13}$ is a $C_1$–$C_4$ alkylene group if d is equal to 1 and e is equal to 2, and $X^1$ is the group of formula (III) wherein $R^{13}$ is a $C_1$–$C_4$ alkylene group if d is equal to 2 and e is equal to 1.

A more preferred embodiment of the inventive amine compound is characterized in that $R^1$ is a $C_1$–$C_6$ alkyl or phenyl group or a $C_7$–$C_{15}$ alkylaryl group; either one of the groups of $R^2$, $R^3$, $R^4$ and $R^5$ is the group of formula (II) while the remaining three groups each are hydrogen or a $C_1$–$C_3$ alkyl group; $R^9$ and $R^{10}$ each are hydrogen or a $C_1$–$C_3$ alkyl group; $R^{11}$ is a $C_2$–$C_4$ alkylene group; $R^{12}$ is a $C_1$–$C_{12}$ alkyl group; f is an integer of between 0 and 20; $R^6$ is a $C_2$–$C_4$ alkylene group including an ethylene group, a 1-methylethylene group, a 2-methylethylene group, a trimethylene group, a butylene group (1-ethylethylene and 2-ethylethylene), a 1,2-dimethylethylene group, a 2,2-dimethylethylene group, a 1-methyltrimethylene group, a 2-methyltrimethylene group, a 3-methyltrimethylene group and a tetramethylene group; $R^7$ and $R^8$ each are a $C_1$–$C_3$ alkylene group such as methylene, ethylene, 1-methylethylene, 2-methylethylene and trimethylene; a is an integer of between 2 and 50 and b is an integer of between 0 and 50, the sum of a and b being equal to between 2 and 100; c is an integer of 0 or 1, d is an integer of 1, e is an integer of 2, two $X^1$ are the group of formula (III) wherein $R^{13}$ is a $C_1$–$C_{30}$ alkylene group.

An oxygen-containing compound

In formula (IV) representing the oxygen-containing compound according to the invention, $R^1$ is hydrogen or a $C_1$–$C_{30}$ hydrocarbon group, preferably either hydrogen or the groups identified with regard to $R^1$ in formula (I) representing the inventive amine compound, such as a $C_1$–$C_{24}$ straight or branched alkyl group, a $C_2$–$C_{24}$ straight or branched alkenyl group, a $C_5$–$C_{13}$ cycloalkyl or alkylcycloalkyl group, a $C_6$–$C_{18}$ aryl or alkylaryl group, or a $C_7$–$C_{19}$ arylalkyl group.

Preferred examples of alkyl, alkenyl, cycloalkyl, alkylcycloalkyl, aryl, alkylaryl and arylalkyl groups of $R^1$ in formula (IV) are the same as those exemplified herein above with regard to $R^1$ in formula (I).

Particularly preferred examples of $R^1$ in formula (IV) are a $C_1$–$C_{12}$ straight or branched alkyl group and a $C_6$–$C_{18}$ aryl or alkylaryl group, and more preferably a $C_1$–$C_6$ straight or branched alkyl group or phenyl group and a $C_7$–$C_{15}$ straight or branched alkylaryl group.

$R^2$, $R^3$, $R^4$ and $R^5$ each in formula (IV) are hydrogen, a $C_1$–$C_{10}$ hydrocarbon group or a group of formula (II) as already identified herein above with regard to the amine compound of the invention. Such a $C_1$–$C_{10}$ hydrocarbon group is also encompassed by the groups such as a $C_1$–$C_{10}$ straight or branched alkyl group, a $C_2$–$C_{10}$ straight or branched alkenyl group, a $C_5$–$C_{10}$ cycloalkyl or alkylcycloalkyl group, a $C_6$–$C_{10}$ aryl or alkylaryl group and a $C_7$–$C_{10}$ arylalkyl group all of which have been identified with regard to $R^2$ through $R^5$ in the above formula (I) representing the inventive amine compound.

Therefore, preferred examples of alkyl, alkenyl, cycloalkyl, alkylcycloalkyl, aryl, alkylaryl and arylalkyl groups are the same as exemplified herein above with respect to $R^2$ through $R^5$ in the above formula (I). Particularly preferred among these groups is a $C_1$–$C_6$, more preferably $C_1$–$C_3$ straight or branched alkyl group. Needless to mention, the groups of $R^9$, $R^{10}$, $R^{11}$ and $R^{12}$ and f in formula (II) referred herein each are the same as those already identified with regard to the inventive amine compound. Therefore, preferred examples of $R^9$ and $R^{10}$ are hydrogen, a $C_1$–$C_6$ alkyl group or a $C_2$–$C_6$ alkoxyalkyl group, among which hydrogen and a $C_1$–$C_3$ alkyl group are more preferred. Preferred example of $R^{11}$ is a $C_2$–$C_4$ alkylene group or a $C_4$–$C_8$ ethylene group substituted with an alkoxyalkylene group. Preferred examples of $R^{12}$ is hydrogen or the groups identified with regard to $R^1$ in formula (IV). Particularly preferred is a $C_1$–$C_{24}$, more preferably $C_1$–$C_{12}$ alkyl group. f is preferably an integer of between 0 and 30, more preferably between 0 and 20. Importantly, at least one of $R^2$, $R^3$, $R^4$ and $R^5$ in formula (IV) is a group of the above formula (II). Preferably, one or two of $R^2$–$R^5$ groups in formula (IV) are the groups of the above formula (II), while the remaining three or two groups each are hydrogen or a $C_1$–$C_6$ alkyl group. More preferably, one of $R^2$–$R^5$ groups in formula (IV) is "preferred substituent" or "more preferred substituent" both of which have been identified with regard to the above formula (II), while the remaining three each are hydrogen or a $C_1$–$C_3$ alkyl group.

The groups of $R^6$ and $R^7$ in formula (IV) each are the same as those already identified with regard to formula (I) representing the inventive amine compound. Therefore, particularly preferred example of $R^6$ is a $C_2$–$C_4$ alkylene group such as those exemplified with regard to the inventive amine compound.

Preferred example of $R^7$ is a $C_1$–$C_4$ alkylene group and particularly preferred is a $C_1$–$C_3$ alkylene group, all of which groups have been exemplified with regard to the inventive amine compound.

In formula (IV) representing the inventive oxygen-containing compound, a is an integer of between 1 and 100, preferably 2 and 50, more preferably 5 and 50 and b is an integer of between 0 and 100, preferably between 0 and 50, the sum of a and b being equal to an integer of between 1 and 200, preferably between 2 and 100, more preferably between 5 and 100.

The inventive oxygen-containing compound has a group of the formula

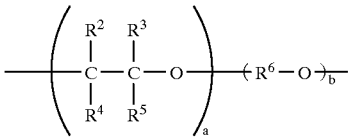

(VI)

The above group includes 1–100, preferably 2–50, more preferably 5–30 of a constituent unit of the formula

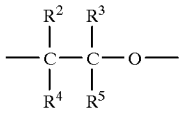

(VII)

and 0–100, preferably 0–50, more preferably 0–30 of a constituent unit of the formula $$—R^6—O— \quad \text{(VIII)}$$

The sum of constituent units (VII) and (VIII) is between 1 and 200, preferably 2 and 100, more preferably 5 and 100.

$R^2$, $R^3$, $R^4$, $R^5$ and $R^6$ and a and b in formula (VI) are the same as indicated in formula (IV). $R^2$, $R^3$, $R^4$ any $R^5$ in formula (VII) are the same as indicated in formula (IV). $R^6$ in formula (VIII) is the same as indicated in formula (IV).

The group represented by formula (VI) referred to herein is also the group derivable from the polymers (1)–(6) already described with regard to the inventive amine compound.

In formula (IV) the constituent units (VII) and (VIII) are shown bonded to $R^1$—O— group and

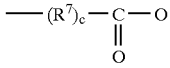

group, respectively. This representation is arbitrary and may be reversed or at random in order.

In formula (IV), c is an integer of 0 or 1.

If c is equal to 0, the inventive oxygen-containing compound is indicated by the formula

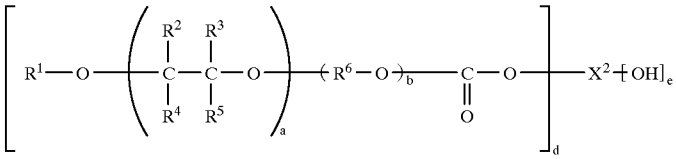

(XIII)

wherein the group of the formula

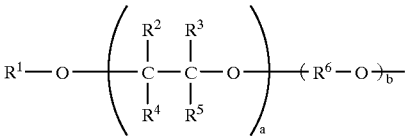

(X)

is directly to the carbon atom of carboxyl group.

$R^1$, $R^2$, $R^3$, $R^4$, $R^5$ and $R^6$, $X^2$, a, b, d and e in formula (XIII) are the same as indicated in formula (IV).

R1, $R^2$, $R^3$, $R^4$, $R^5$ and $R^6$, $X^2$, a and b in formula (X) are the same as indicated in formula (IV). If c is equal to 1, the inventive oxygen-containing compound is indicated by the formula (XIV)

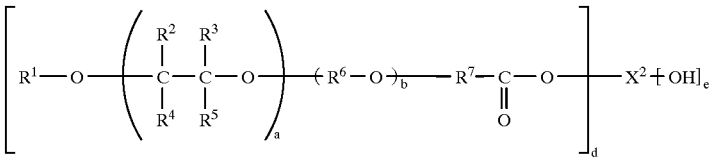

wherein the group of formula (X) is bonded through an alkylene group "—$R^7$—" to the carbon atom of carbonyl group.

R1, $R^2$, $R^3$, $R^4$, $R^5$, $R^6$ and $R^7$, $X^2$ and a, b, d and e in formula (XIV) are the same as indicated in formula (IV).

In formula (IV), d is an integer of between 1 and 19, preferably between 1 and 9 and e is an integer of between 1 and 19, preferably between 1 and 9, the sum of d and e being equal to 2–20, preferably 2–10.

In formula (IV), if d is more than two, the inventive oxygen-containing compound has more than two groups of the formula (XV)

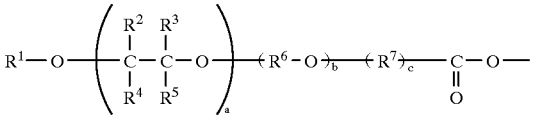

per molecule. These groups may be the same or different structure.

$R^1$, $R^2$, $R^3$, $R^4$, $R^5$, $R^6$ and $R^7$, and a, b and c in formula (XV) are the same as indicated in formula (IV).

In formula (IV) representing the inventive oxygen-containing compound, $X^2$ is a residual group of a nitrogen-free polyhydric alcohol having 2 to 20, preferably 2–10 hydroxyl groups. Namely, the term residual group used herein is a group which excludes all of hydroxyl groups from polyhydric alcohol. Such a residual group of polyhydric alcohol includes those having preferably 2 to 60, more preferably 2–40, particularly preferably 3–20 carbon atoms. The residual group is not limited to a hydrocarbon group and may have at least one of ether, carbonyl and ester groups.

Specific examples of polyhydric alcohol include diol such as ethylene glycol, 1,3-propane diol, propylene glycol, 1,4-butane diol, 1,2-butane diol, 2-methyl-1,3-propane diol, 1,5-pentane diol, neopentyl glycol, 1,6-hexane diol, 2-ethyl-2-methyl-1,3-propane diol, 1,7-heptane diol, 2-methyl-2-propyl-1,3-propane diol, 2,2-diethyl-1,3-propane diol, 1,8-octane diol, 1,9-nonane diol, 1,10-decane diol, 1,11-undecane diol and 1,12-dodecane diol; polyol such as trimethylolethane, trimethylolpropane, trimethylolbutane, di-(trimethylolethane), tri-(trimethylolethane), tetra-(trimethylolethane), di-(trimethylolpropane), tri-(trimethylolpropane, tetra-(trimethylolpropane), di-(trimethylolbutane), tri-(trimethylolbutane), tetra-(trimethylolbutane), pentaerythritol, di-(pentaerythritol), tri-(pentaerythritol), tetra-(pentaerythritol), glycerin, polyglycerine (dimer to icosamer of glycerin), 1,2,4-butane triol, 1,3,5-pentane triol, 1,2,6-hexane triol, 1,2,3,4-butane tetraol, soribitol, sorbitan, sorbitol glycerin condensate, galactitol, adomitol, arabitol, xylitol, mannitol, talitol, dulcitol, and allitol; polyhydric alcohol dehydrates such as isosorbite(1,4,3,6-sorbitol); sacchrides such as monosaccharides including xylose, arabinose, ribose, rhamnose, glucose, tructose, galactose, mannose and sorbose, disaccharides including cellobiose, maltose, isomaltose, trehalose and sucrose and trisaccharides including raffinose, gentianose and melezitose; glycoside such as methylglucoside; and etherificates thereof.

Preferred are neopentylglycol, glycerin, diglycerin, triglycerin, trimethylolethane, trimethylolpropane, trimethylolbutane, di-(trimethylolethane), tri-(trimethylolethane), di-(trimethylolpropane), tri-(trimethylolpropane), di-(trimethylolbutane), tri-(trimethylolbutane), pentaerythritol, di-(pentaerythritol), tri-(pentaerythritol), sorbitol, sorbitan, galactitol and glucose.

A typical preferred embodiment of the inventive oxygen-containing compound having thus been described with respect to the various substituents in formula (IV) may be represented in which $R^1$ is a $C_1$–$C_{12}$ straight or branched alkyl group or a $C_6$–$C_{18}$ aryl or alkylaryl group; one or two of the groups of $R^2$, $R^3$, $R^4$ and $R^5$ are the group of formula (II) and the remaining groups each are hydrogen or a $C_1$–$C_6$ alkyl group; $R^9$ and $R^{10}$ each are hydrogen, a $C_1$–$C_6$ alkyl group or a $C_2$–$C_6$ alkoxyalkyl group; $R^{11}$ is a $C_2$–$C_6$ alkylene group or a $C_4$–$C_8$ alkoxyalkyl-substituted ethylene group; $R^{12}$ is a $C_1$–$C_{24}$ alkyl group; f is an integer of between 0 and 30; $R^6$ is a $C_2$–$C_4$ alkylene group; $R^7$ is a $C_1$–$C_4$ alkylene group; a is an integer of between 1 and 100 and b is an integer of between 0 and 100, the sum of a and b being between 1 and 200; c is an integer of between 0 and 1, d is an integer of between 1 and 9, and e is an integer of between 1 and 9, the sum of d and e being an integer of between 2 and 10; $X^2$ is a residual group of nitrogen-free polyhydric alcohol having 2–40 carbon atoms and 2–10 hydroxyl groups.

A more preferred embodiment of the inventive oxygen-containing compound is characterized in that $R^1$ is a $C_1$–$C_6$ alkyl or phenyl group or a $C_7$–$C_{15}$ alkylaryl group; either one of the groups of $R^2$, $R^3$, $R^4$ and $R^5$ is the group of formula (II) while the remaining three groups each are hydrogen or a $C_1$–$C_3$ alkyl group; $R^9$ and $R^{10}$ each are hydrogen or a $C_1$–$C_3$ alkyl group; $R^{11}$ is a $C_2$–$C_4$ alkylene group; $R^{12}$ is a $C_1$–$C_{12}$ alkyl group; f is an integer of between 0 and 20; $R^6$ is a $C_2$–$C_4$ alkylene group including ethylene, 1-methylethylene, 2-methylethylene, trimethylene, butylene (1-ethylethylene, 2-ethylethylene), 1,2-dimethylethylene, 2,2-dimethylethylene, 1-methyltrimethylene, 2-methyltrimethylene, 3-methyltrimethylene and tetramethylene groups; $R^7$ is a $C_1$–$C_3$ alkylene group such as methylene, ethylene, 1-methylethylene, 2-methylethylene and trimethylene; a is an integer of between 2 and 50 and b is an integer of between 0 and 50, the sum of a and b being equal to between 2 and 100; c is an integer of 0 or 1, d is an integer of between 1 and 9; e is an integer of between 1 and 9; the sum of d and e being equal to between 2 and 10; and $X^2$ is a residual group of nitrogen-free polyhydric alcohol having 3–20 carbon atoms and 2–10 hydroxyl groups.

A nitrogen-containing compound

In formula (V) representing the nitrogen-containing compound according to the invention, $R^1$ is hydrogen or a $C_1$–$C_{30}$ hydrocarbon group, preferably either hydrogen or the groups identified with regard to $R^1$ in formula (I) representing the inventive amine compound described above, such as a $C_1$–$C_{24}$ straight or branched alkyl group, a $C_2$–$C_{24}$ straight or branched alkenyl group, a $C_5$–$C_{13}$ cycloalkyl or alkylcycloalkyl group, a $C_6$–$C_{18}$ aryl or alkylaryl group, or a $C_7$–$C_{19}$ arylalkyl group.

Preferred examples of alkyl, alkenyl, cycloalkyl, alkylcycloalkyl, aryl, alkylaryl and arylalkyl groups of $R^1$ in formula (V) are thus the same as those exemplified herein above with regard to $R^1$ in formula (I).

Particularly preferred examples of $R^1$ in formula (V) are also a $C_1$–$C_{12}$ straight or branched alkyl group and a $C_6$–$C_{18}$ aryl or alkylaryl group, and more preferably a $C_1$–$C_6$ straight or branched alkyl group or phenyl group and a $C_7$–$C_{15}$ straight or branched alkylaryl group.

$R^2$, $R^3$, $R^4$ and $R^5$ each in formula (V) are hydrogen, a $C_1$–$C_{10}$ hydrocarbon group or a group of formula (II) as already identified herein above with regard to the amine compound of the invention. Such a $C_1$–$C_{10}$ hydrocarbon group is also encompassed by the groups such as a $C_1$–$C_{10}$ straight or branched alkyl group, a $C_2$–$C_{10}$ straight or branched alkenyl group, a $C_5$–$C_{10}$ cycloalkyl or alkylcycloalkyl group, a $C_6$–$C_{10}$ aryl or alkylaryl group and a $C_7$–$C_{10}$ arylalkyl group all of which have been identified with regard to $R^2$ through $R^5$ in formula (I) representing the inventive amine compound.

Therefore, preferred examples of alkyl, alkenyl, cycloalkyl, alkylcycloalkyl, aryl, alkylaryl and arylalkyl groups are the same as exemplified herein above for $R^2$ through $R^5$ in the above formula (I). Particularly preferred among these groups is a $C_1$–$C_6$, more preferably $C_1$–$C_3$ straight or branched alkyl group. Needless to mention, the groups of $R^9$, $R^{10}$, $R^{11}$ and $R^{12}$ and f in formula (II) referred herein each are the same as those already identified with regard to the inventive amine compound. Therefore, preferred examples of $R^9$ and $R^{10}$ are hydrogen, a $C_1$–$C_6$ alkyl group or a $C_2$–$C_6$ alkoxyalkyl group, among which hydrogen and a $C_1$–$C_3$ alkyl group are more preferred. Preferred example of $R^{11}$ is a $C_2$–$C_4$ alkylene group or a $C_4$–$C_8$ ethylene group substituted with an alkoxyalkylene group. Preferred examples of $R^{12}$ is hydrogen or the groups identified with regard to $R^1$ in formula (V). Particularly preferred is a $C_1$–$C_{24}$, more preferably $C_1$–$C_{12}$ alkyl group. f is preferably an integer of between 0 and 30, more preferably between 0 and 20. Importantly, at least one of $R^2$, $R^3$, $R^4$ and $R^5$ in formula (VI) is a group of the above formula (II). Preferably, one or two of $R^2$–$R^5$ groups in formula (V) are the groups of the above formula (II), while the remaining three or two groups each are hydrogen or a $C_1$–$C_6$ alkyl group. More preferably, one of $R^2$–$R^5$ groups in formula (V) is "preferred substituent" or "more preferred substituent" both of which have been identified with regard to the above formula (II), while the remaining three each are hydrogen or a $C_1$–$C_3$ alkyl group.

The groups of $R^6$ and $R^7$ in formula (V) each are the same as those already identified with regard to formula (I) representing the inventive amine compound. Therefore, particularly preferred example of $R^6$ is a $C_2$–$C_4$ alkylene group such as those exemplified with regard to the inventive amine compound.

Preferred example of $R^7$ is a $C_1$–$C_4$ alkylene group and particularly preferred is a $C_1$–$C_3$ alkylene group, all of which groups have been exemplified with regard to the inventive amine compound.

In formula (V) representing the inventive nitrogen-containing compound, a is an integer of between 1 and 100, preferably 2 and 50, more preferably 5 and 50 and b is an integer of between 0 and 100, preferably between 0 and 50, the sum of a and b being equal to between 1 and 200, preferably between 2 and 100, more preferably between 5 and 100.

The inventive oxygen-containing compound has a group of the formula

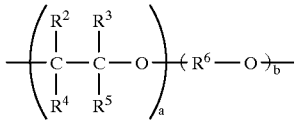

(VI)

The above group includes 1–100, preferably 2–50, more preferably 5–30 of a constituent unit of the formula

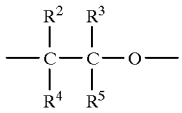

(VII)

and 0–100, preferably 0–50, more preferably 0–30 of a constituent unit of the formula (VIII)

The sum of constituent units of the formulae (VII) and (VIII) is between 1 and 200, preferably 2 and 100, more preferably 5 and 100.

$R^2$, $R^3$, $R^4$, $R^5$ and $R^6$ and a and b in formula (VI) are the same as indicated in formula (V). $R^2$, $R^3$, $R^4$ and $R^5$ in formula (VII) are the same as indicated in formula (V). $R^6$ in formula (VIII) is the same as indicated in formula (V).

The group represented by formula (VI) referred to herein is also the group derivable from the polymers (1)–(6) already described with regard to the inventive amine compound.

In formula (V) the constituent units (VII) and (VIII) are shown bonded to $R^1$—O— group and

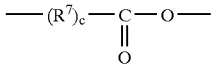

groups, respectively. This representation is arbitrary and may be reversed or at random in order.

In formula (V), c is an integer of 0 or 1.

If c is equal to 0, the inventive nitrogen-containing compound is indicated by the formula

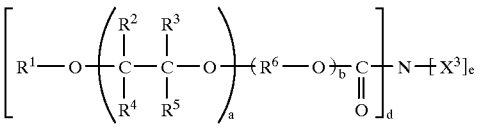

(XVI)

wherein a group of the formula (X)

(X)

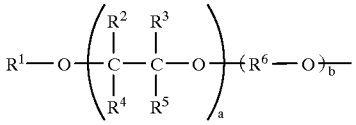

is directly bonded to the carbon atom of carboxyl group.

$R^1$, $R^2$, $R^3$, $R^4$, $R^5$ and $R^6$, $X^3$, a, b, d and e in formula (XVI) are the same as indicated in formula (V).

$R^1$, $R^2$, $R^3$, $R^4$, $R^5$ and $R^6$, a and b in formula (X) are the same as indicated in formula (V). If c is equal to 1, the inventive nitrogen-containing compound is indicated by the formula (XVII)

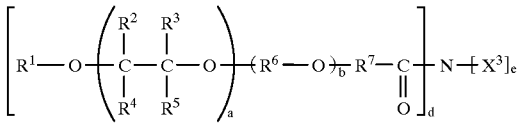

wherein the group of the above formula (X) is bonded through an alkylene group "—$R^7$—" to the carbon atom of carbonyl group.

$R^1$, $R^2$, $R^3$, $R^4$, $R^5$, $R^6$ and $R^7$, $X^3$ and a, b, d and e in formula (XVII) are the same as indicated in formula (V).

In formula (V), d and e each are an integer of between 1 and 2, the sum of d and e being equal to 3, and preferably d is equal to 1 and e is equal to 2.

In formula (V), if d is equal to 2, the inventive nitrogen-containing compound has two groups of the formula (XVIII)

(XVIII)

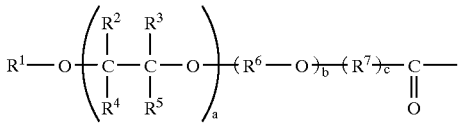

These groups may be the same or different structure.

$R^1$, $R^2$, $R^3$, $R^4$, $R^5$, $R^6$ and $R^7$, and a, b and c in formula (XVIII) are the same as indicated in formula (V).

In formula (V) representing the inventive nitrogen-containing compound, if e is equal to 1 $X^3$ is (a) an organic residual group having at least one hydroxyl group.

If e is equal to 2, 1) one of $X^3$ is (a) an organic residual group having at least one hydroxyl group and the other is selected from the group consisting of (a) an organic residual group having at least one hydroxyl group, (b) hydrogen and (c) a $C_1$–$C_{30}$ hydrocarbon group; or 2) $X^3$ represents a heterocyclic ring containing the nitrogen atom in formula (V) joined therein and having at least one hydroxyl group.

The term organic residual group having at least one hydroxyl group used herein are those having 1–19, preferably 1–9 and more preferably 1–6 hydroxyl groups, and 1–60, preferably 1–40, more preferably 1–20 carbon atoms. Preferred example of organic residual group are preferably alkanol groups which may have amino, imino, ether, carboxyl or ester groups.

Particularly preferred organic residual groups having at least one hydroxyl group are alkanol groups which have 1–60, preferably 1–40, more preferably 1–20 hydrocarbon groups and 1–19, preferably 1–9, more preferably 1–6 hydroxyl groups and may contain more than one amino, imino, ether, carbonyl or ester group.

Particularly preferred organic residual groups exemplarily include methanol, ethanol (the position of hydroxyl group is optional), straight or branched butanol (the position of hydroxyl group is optional), straight or branched pentanol (the position of hydroxyl group is optional), straight or branched hexanol (the position of hydroxyl group is optional) groups, and groups of the following general formulae

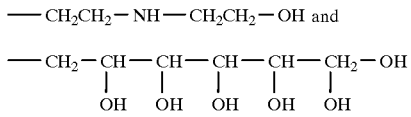

The $C_1$–$C_{30}$ hydrocarbon group (c) includes the above-mentioned group of $R^1$, such as a $C_1$–$C_{24}$ straight or branched alkyl group, a $C_2$–$C_{24}$ straight or branched alkyl group, a $C_5$–$C_{13}$ cycloalkyl or alkylcycloalkyl group a $C_6$–$C_{18}$ aryl or alkylaryl group and a $C_7$–$C_{19}$ arylalkyl groups. Preferred are a $C_1$–$C_{12}$ straight or branched alkyl group or a $C_6$–$C_{12}$ aryl or alkylaryl group. More preferred are a $C_1$–$C_6$ alkyl or phenyl group, and a $C_7$–$C_9$ alkylaryl group.

In formula (V), if e is equal to 2, both two groups $X^3$ are preferably organic residual groups having at least one hydroxyl group (a).

Alternatively there may also be used a nitrogen-containing compound of formula (V) in which e is equal to 2 and $X^3$ represents a heterocyclic ring containing the nitrogen atom in formula (V) joined therein and having at least one hydroxyl group. Such a compound is represented by the formula (XIX)

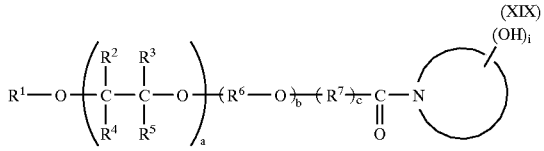

wherein i is an integer of greater than 1, preferably of between 1 and 3. $R^1$ through $R^7$ and a, b and c in formula (XIX) are the same as indicated in formula (V). The formula of (XIXa)

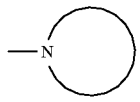

wherein N is an nitrogen atom in formula (V) indicates a heterocyclic ring derived from a heterocyclic compound of the formula (XIXb)

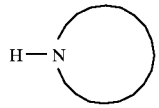

The heterocyclic ring used herein may have a $C_1$–$C_{10}$ organic residuous group or amino groups bonded thereto other than hydroxyl groups. Preferred examples of heterocyclic compound of formula (XIXb) include pyrrolidine, pyrroline, pyrrole, pyrazolidine, pyrazoline, pyrazole, imidazolidine, imidazoline, imidazole, furoxane, piperidine, piperadine, morpholine, indoline, indole, isoindole, purine, carbazole, β-carboline, phenoxazine and perimidien.

A typical preferred embodiment of the inventive nitrogen-containing compound having thus been described with respect to the various substituents in formula (V) may be represented in which $R^1$ is a $C_1$–$C_{12}$ straight or branched alkyl group or a $C_6$–$C_{18}$ aryl or alkylaryl group; one or two of the groups of $R^2$, $R^3$, $R^4$ and $R^5$ are the group of formula (II) and the remaining groups each are hydrogen or a $C_1$–$C_6$ alkyl group; $R^9$ and $R^{10}$ each are hydrogen, a $C_1$–$C_6$ alkyl group or a $C_2$–$C_6$ alkoxyalkyl group; $R^{11}$ is a $C_2$–$C_6$ alkylene group or a $C_4$–$C_8$ alkoxyalkyl-substituted ethylene group; $R^{12}$ is a $C_1$–$C_{24}$ alkyl group; f is an integer of between 0 and 30; $R^6$ is a $C_2$–$C_4$ alkylene group; $R^7$ is a $C_1$–$C_4$ alkylene group; a is an integer of between 1 and 100 and b is an integer of between 0 and 100, the sum of a and b being between 1 and 200; c is an integer of between 0 and 1 and d is an integer of between 1 and 2, e is an integer of 1 and 2, the sum of d and e being equal to 3; if d and e are equal to 2 and 1 respectively, $X^3$ is (a) an organic residual group having at least one hydroxyl group and if d and e are equal to 1 and 2, respectively, 1) one of $X^3$ is (a) an organic residual group having at least one hydroxyl group and the other is one selected from the group consisting of (a) an organic residual group having at least one hydroxyl group, (b) hydrogen and (c) a $C_1$–$C_{30}$ hydrocarbon group; or 2) $X^3$ represents a heterocyclic ring containing the nitrogen atom in formula (V) joined therein and having at least one hydroxyl group.

A more preferred embodiment of the inventive amide compound is characterized in that $R^1$ is a $C_1$–$C_6$ alkyl or phenyl group or a $C_7$–$C_{15}$ alkylaryl group; either one of the groups of $R^2$, $R^3$, $R^4$ and $R^5$ is the group of formula (II) while the remaining three groups each are hydrogen or a $C_1$–$C_3$ alkyl group; $R^9$ and $R^{10}$ each are hydrogen or a $C_1$–$C_3$ alkyl group; $R^{11}$ is a $C_2$–$C_4$ alkylene group; $R^{12}$ is a $C_1$–$C_{12}$ alkyl group; f is an integer of between 0 and 20; $R^6$ is a $C_2$–$C_4$ alkylene group including ethylene, 1-methylethylene, 2-methylethylene, trimethylene, butylene (1-ethylethylene, 2-ethylethylene), 1,2-dimethylethylene, 2,2-dimethylethylene, 1-methyltrimethylene, 2-methyltrimethylene, 3-methyltrimethylene and tetramethylene groups; $R^7$ is a $C_1$–$C_3$ alkylene group such as methylene, ethylene, 1-methylethylene, 2-methylethylene and trimethylene; a is an integer of between 2 and 50 and b is an integer of between 0 and 50, the sum of a and b being equal to between 2 and 100; c is an integer of 0 or 1, d and e each are an integer of between 1 and 2, the sum of d and e being equal to 3; if d and e are equal to 2 and 1 respectively, $X^3$ is (a) an organic residual group having at least one hydroxyl group and if d and e are equal to 1 and 2, 1) one of $X^3$ is (a) an organic residual group having at least one hydroxyl group and the other is one selected from the group consisting of (a) an organic residual group having at least one hydroxyl group, (b) hydrogen and (c) a $C_1$–$C_{30}$ hydrocarbon group; or 2) $X^3$ represents a heterocyclic ring containing the nitrogen atom in formula (V) joined therein and having at least one hydroxyl group.

The amine compound (A), the nitrogen-containing compound (B) and the oxygen-containing compound (C) according to the invention may be prepared by any suitable methods known in the art. One such method of each compounds is shown below.

Amine Compound (A)

Polymerization

In the presence of a base such as potassium hydroxide, sodium hydroxide and alkoxide thereof as a catalyst, a polymerization product in the form of metal alkoxide is prepared with one of the following methods 1) An epoxy compound of the formula (XX)

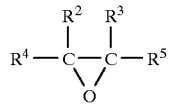

where $R^2$, $R^3$, $R^4$ and $R^5$ are the same as indicated in formula (I) is polymerized with addition of an oxygen-containing compound of the formula as a reaction initiator $$R^1—OH \quad \text{(XXI)}$$

where $R^1$ is the same as in the formula (I)

2) A mixture of the epoxy compound of formula (XXVII) and an oxirane compound of formula $$R^6(=O) \quad \text{(XXII)}$$

where $R^6$ is the same as indicated in the formula (I) is polymerized with addition of the oxygen-containing compound of formula (XXI) as a reaction initiator. The oxirane compound of formula (XXII) is formed with two hydrogen atoms in the alkylene group $R^6$ substituted by one oxygen atom.

3) The epoxy compound of formula (XX) is polymerized first with the reaction initiator of formula (XXI) to obtain homopolymer thereof and then polymerized with the oxirane compound of formula (XXII).

4) The oxirane compound of formula (XXII) is polymerized first with the reaction initiator of formula (XXI) to obtain homopolymer thereof and then polymerized with the epoxy compound of formula (XX).

The resulting polymerization product is neutralized with acids such as hydrochloric acid thereby obtaining a polyoxyalkylene glycol derivatives of the formula (XXIII)

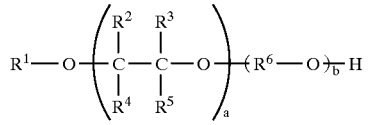

where $R^1$, $R^2$, $R^3$, $R^4$, $R^5$ and $R^6$, a and b are the same as indicated in formula (I).

The polyoxyalkylene glycol derivative of the formula (XXIII) in which b is not equal to 0 may be a block copolymer or a random copolymer.

Preferred examples of the epoxy compound of formula (XX) include methylglycidyl ether, ethylglycidyl ether, n-propylglycidyl ether, isopropylglycidyl ether, n-butylglycidylether, isobutylglycidyl ether, sec-butylglycidyl ether, tert-butylglycidyl ether, straight or branched pentylglycidyl ether, straight or branched hexylglycidyl ether, straight or branched heptylglycidyl ether, straight or branched octylglycidyl ether, straight or branched nonylglycidyl ether, straight or branched decylglycidyl ether, straight or branched undecylglycidyl ether, straight or branched dodecylglycidyl ether, straight or branched tridecylglycidyl ether, straight or branched tetradecylglycidyl ether, straight or branched pentadecylglycidyl ether, straight or branched hexadecylglycidyl ether, straight or branched heptadecylglycidyl ether, straight or branched octadecylglycidyl ether, vinylglycidyl ether, straight or branched propenylglycidyl ether, straight or branched butenylglycidyl ether, straight or branched pentenylglycidyl ether, straight or branched hexenylglycidyl ether, straight or branched heptenylglycidyl ether, straight or branched octenylglycidyl ether, straight or branched nonenylglycidyl ether, straight or branched decenylglycidyl ether, straight or branched undecenylglycidyl ether, straight or branched dodecenylglycidyl ether, straight or branched tridecenylglycidyl ether, straight or branched tetradecenylglycidyl ether, straight or branched pentadecenylglycidyl ether, straight or branched hexadecenylglycidyl ether, straight or branched heptadecenylglycidyl ether, straight or branched octadecenylglycidyl ether, phenylglycidyl ether, tolylglycidyl ether, xylylglycidyl ether, ethylphenylglycidyl ether, straight or branched propylphenylglycidyl ether, straight or branched butylphenylglycidyl ether, straight or branched pentylphenylglycidyl ether, straight or branched hexylphenylglycidyl ether, straight or branched heptylphenylglycidyl ether, straight or branched octylphenylglycidyl ether, straight or branched nonylphenylglycidyl ether, straight or branched decylphenylglycidyl ether, straight or branched undecylphenylglycidyl ether, straight or branched dodecylphenylglycidyl ether, straight or branched tridecylphenylglycidyl ether, 1,2-epoxy-3-methoxy-5-oxahexane, 1,2-epoxy-4,7-dioxaoctane, 4,5-epoxy-2,7-dioxaoctane, 1,2-epoxy-5-methyl-4,7-dioxaoctane, 1,2-epoxy-6-methyl-4,7-dioxaoctane, 1,2-epoxy-5-(2-oxapropyl)-4,7-dioxaoctane, 1,2-epoxy-3,5-bis(2-oxapropyl)-4,7-dioxaoctane, 1,2-epoxy-3,6-bis(2-oxapropyl)-4,7-dioxaoctane, 1,2-epoxy-6-methoxy-4,8-dioxanonane, 1,2-epoxy-4,7,10-trioxaundecane, 1,2-epoxy-5-methyl-4,7,10-trioxaundecane, 1,2-epoxy-8-methyl-4,7,10-trioxaundecane, 4,5-epoxy-9-methyl-2,7,10-trioxaundecane, 1,2-epoxy-6,9-dimethyl-4,7,10-trioxaundecane, 1,2-epoxy-6,9-bis(2-oxapropyl)-4,7,10-trioxaundecane, 1,2-epoxy-4,7,10,13-tetraoxatetradecane, 4,5-epoxy-2,7,10,13-tetraoxateradecane, 7,8-epoxy-2,5,10,13-tetraoxateradecane, 7,8-epoxy-3,12-dimethyl-2,5,10,13-tetraoxatetradecane and 1,2-epoxy-6,9,12-trimethyl-4,7,10,13-tetraoxatetradecane.

Preferred examples of the oxirane compound of formula (XXII) include ethylene oxide, propylene oxide, isobutylene oxide, 1-butene oxide (1,2-butylene oxide), 2-butene oxide, 1-pentene oxide, trimethylethylene oxide, 1-hexene oxide and tetramethylethylene oxide.

Although not restricted, the ratio of the epoxy compound of formula (XX) or the mixture thereof with the oxirane compound of formula (XXII) to the oxygen-containing compound of formula (XXI) is preferably in the range of 5–100 mols per mol of the oxygen-containing compound.

Polymerization may be carried out at a temperature of 60° C.–180° C., preferably 80° C.–150° C.

Chloroformation

The polyoxyalkylene glycol derivative of formula (XXIII) or the metalic alkoxide thereof prior to be neutralized obtained as above may be subjected to chloroformation at room temperature in the presence of excess phosgene thereby obtaining chlorine-containing compound of the formula (XXIV)

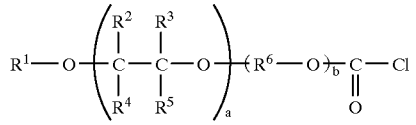

where $R^1$, $R^2$, $R^3$, $R^4$, $R^5$ and $R^6$ and a and b are the same as indicated in the formula (I).

Carbonic esterification

The chlorine-containing compound of formula (XXIV) obtained as above may be subjected to reaction with alkanol amine of the formula $$[HO—R^8]_d—N—[X^1]_e \quad (XXV)$$

where $R^8$, $X^1$, d and e are the same as indicated in formula (I), thereby obtaining the amine compound of the invention.

In formula (XXV) where d is equal to 1 and e is equal to 2, two $X^1$ may be the same or different structure. In formula (XXV) where d is equal to 2 and e is equal to 1, two groups $R^8$ may be the same or different structure.

Preferred examples of the alkanol amine of formula (XXV) include trimethanol amine, methyldimethanol amine, ethyldimethanol amine, triethanol amine, methylethanol amine, ethyldiethanol amine, tri-n-propanol amine, methyl-di-n-propanol amine, ethyl-di-n-propanol amine, triisopropanol amine, methyldiisopropanol amine, ethyldiisopropanol amine, tri(straight or branched) butanol amine, methyldi(straight or branched) butanol amine, ethyldi (straight or branched) butanol amine, tri(straight or branched) pentanol amine, methyldi(straight or branched) pentanol amine and ethyldi(straight or branched) pentanol amine.

Although not restricted, the ratio of the alkanol amine of formula (XXV) to the chlorine-containing compound of formula (XXIV) is more than one mol, more preferably 1–20 mols per mol of the chlorine-containing compound. Reaction temperature is in the range of −20° C.–150° C., preferably −10° C.–80° C.

Alternatively, to produce the inventive amine compound there may be employed introduction of ester group and ester interchange reaction after the polymerization in places of chloroformation and carbonic esterification steps described above.

Introducing of ester group

The polyoxyalkylene glycol derivative of formula (XXIII) or the metal alkoxide compound thereof prior to be neutralized obtained by the above-mentioned polymerization may be reacted with an ester of monohalocarboxylic acid of the formula (XXVI)

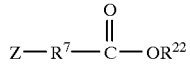

wherein $R^7$ is the same as indicated in formula (I), $R^{22}$ is hydrogen or a $C_1$–$C_{30}$ hydrocarbon group and Z is chlorine, bromine or iodine thereby obtaining an ester compound represented by the formula (XXVII)

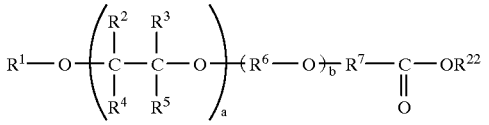

wherein $R^1$, $R^2$, $R^3$, $R^4$, $R^5$, $R^6$ and $R^7$ and a and b are the same as indicated in the formula (I) and $R^{22}$ is the same as indicated in the formula (XXVI).

$R^{22}$ in the formula (XXVI) is hydrogen or a $C_1$–$C_{30}$ hydrocarbon group, preferably hydrogen, a $C_1$–$C_{24}$ straight or branched alkyl group, a $C_2$–$C_{24}$ straight or branched alkenyl group, a $C_5$–$C_{13}$ cycloalkyl or alkylcycloalkyl group, a $C_6$–$C_{18}$ aryl or alkylaryl group or a $C_7$–$C_{19}$ arylalkyl group.

Preferred examples of alkyl group $R^{22}$ include methyl, ethyl, n-propyl, isopropyl, n-butyl, isobutyl, sec-butyl, tert-butyl, straight or branched pentyl, straight or branched hexyl,straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched icosyl, straight or branched henicosyl, straight or branched docosyl, straight or branched tricosyl and straight or branched tetracosyl.

Preferred examples of alkenyl group $R^{22}$ include vinyl, propenyl, isopropenyl, straight or branched butenyl, butadienyl, straight or branched pentenyl, straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl such as oleyl, straight or branched nonadecenyl, straight or branched icosenyl, straight or branched henicosenyl, straight or branched docosenyl, straight or branched tricosenyl and straight or branched tetracosenyl.

Preferred examples of cycloalkyl group $R^{22}$ include cyclopentyl, cyclohexyl and cycloheptyl. Preferred examples of alkylcycloalkyl group $R^{22}$ include methylcyclopentyl (inclusive all isomers), dimethylcyclopentyl (inclusive of all isomers), ethylcyclopentyl (inclusive of all isomers), straight or branched propylcyclopentyl (inclusive of all isomers), ethylmethylcyclopentyl (inclusive of all isomers), trimethylcyclopentyl (inclusive of all isomers), diethylcyclopentyl (inclusive of all isomers), ethyldimethylcyclopentyl (inclusive of all isomers), straight or branched propylmethylcyclopentyl (inclusive of all isomers), straight or branched propylethylcyclopentyl (inclusive of all isomers), di-straight or branched propylcyclopentyl (inclusive of all isomers), straight or branched propylethylmethylcyclopentyl (inclusive of all isomers), methylcyclohexyl (inclusive of all isomers), dimethylcyclohexyl (inclusive of all isomers), ethylcyclohexyl (inclusive of all isomers), straight or branched propylcyclohexyl (inclusive of all isomers), ethylmethylcyclohexyl (inclusive of all isomers), trimethylcyclohexyl (inclusive of all isomers), diethylcyclohexyl (inclusive of all isomers), ethyldimethylcyclohexyl (inclusive of all isomers), straight or branched propylmethylcyclohexyl (inclusive of all isomers), straight or branched propylethylcyclohexyl (inclusive of all isomers), di-straight or branched propylcyclohexyl (inclusive of all isomers), straight or branched propylethylmethylcyclohexyl (inclusive of all isomers), methylcycloheptyl (inclusive of all isomers), dimethycycloheptyl (inclusive of all isomers), ethylcycloheptyl (inclusive of all isomers), straight or branched propylcycloheptyl (inclusive of all isomers), ethylmethylcycloheptyl (inclusive of all isomers), trimethylcycloheptyl (inclusive of all isomers), diethylcycloheptyl (inclusive of all isomers), ethyldimethylcycloheptyl (inclusive of all isomers), straight or branched propylmethylcycloheptyl (inclusive of all isomers), straight or branched propylethylcycloheptyl (inclusive of all isomers), di-straight or branched propylcycloheptyl (inclusive of all isomers) and straight or branched propylethylmethylcycloheptyl (inclusive of all isomers).

Preferred examples of aryl group $R^{22}$ include phenyl and naphthyl, and alkylaryl group $R^{22}$ include tolyl (inclusive of all isomers), xylyl (inclusive of all isomers), ethylphenyl (inclusive of all isomers), straight or branched propylphenyl (inclusive of all isomers), ethylmethylphenyl (inclusive of all isomers), trimethylphenyl (inclusive of all isomers), straight or branched butylphenyl (inclusive of all isomers), straight or branched propylmethyiphenyl (inclusive of all isomers), diethylphenyl (inclusive of all isomers), ethyldimethylphenyl (inclusive of all isomers), tetramethylphenyl (inclusive of all isomers), straight or branched pentylphenyl (inclusive of all isomers), straight or branched hexylphenyl (inclusive of all isomers), straight or branched heptylphenyl (inclusive of all isomers), straight or branched octylphenyl (inclusive of all isomers), straight or branched nonylphenyl (inclusive of all isomers), straight or branched decylphenyl (inclusive of all isomers), straight or branched undecylphenyl (inclusive of all isomers) and straight or branched dodecylphenyl (inclusive of all isomers), and further arylalkyl group $R^{22}$ include benzyl, methylbenzyl (inclusive of all isomers), dimethylbenzyl (inclusive of all isomers), phenethyl, methylphenethyl (inclusive of all isomers) and dimethylphenethyl (inclusive of all isomers).

Particularly preferred $R^{22}$ examples are a $C_1$–$C_{12}$ straight or branched alkyl group and a $C_6$–$C_{12}$ aryl or alkylaryl group, and more preferably a $C_1$–$C_6$ straight or branched alkyl group or phenyl group and a $C_7$–$C_9$ straight or branched alkylaryl group.

Z in the formula (XXVI) is chlorine, bromine and iodine among which chlorine and bromine are particularly preferred.

Although not restricted, the ratio of the ester of monohalocarboxylic acid to the polyoxyalkylene glycol derivative is preferably more than one mol, more preferably 1–20 mols per mol of the polyoxyalkylene glycol derivative.

Reaction temperature is in the range of −20° C.–150° C., preferably −10° C.–80° C.

Ester interchange reaction

The ester compound of formula (XXVII) obtained as above is subjected to ester interchange reaction with the aforesaid alkanol amine compound of formula (XXV) thereby obtaining the inventive amine compound of formula (XI).

Although not restricted, the ratio of the alkanol amine of formula (XXV) to the ester compound of formula (XXVII) is preferably more than one mol, more preferably 1–20 mols per mol of the ester compound.

Reaction temperature is in the range of 60° C.–200° C., preferably 100° C.–160° C.

Oxygen-containing compound (B)

Polymerization

In the presence of the same catalyst as used in the preparation of the inventive amine compound, there is obtained a polymerization product in the form of metal alkoxide with either one of the polymerization methods 1)–4) described with regard to the amine compound. $R^2$, $R^3$, $R^4$ and $R^5$ in formula (XX) representing the epoxy compound used in the polymerization methods 1)–4) and described with regard to the amine compound are the same as indicated in formula (IV). $R^1$ in formula (XXI) representing the oxygen-containing compound used in the polymerization methods 1)–4) and described with regard to the amine compound is the same as indicated in formula (IV). $R^6$ in formula (XXII) representing the oxirane compound used in the polymerization methods 2)–4) and described with regard to the amine compound is the same as indicated in formula (IV). The resulting polymerization product is neutralized with acids such as hydrochloric acid thereby obtaining a polyoxyalkylene glycol derivative of the formula (XXIII)

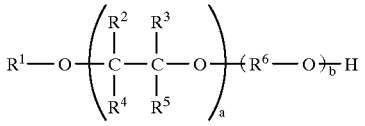

where $R^1$, $R^2$, $R^3$, $R^4$, $R^5$ and $R^6$, and a and b are the same as indicated in formula (IV).

The polyoxyalkylene glycol derivative of formula (XXIII) in which b is not equal to 0 may be a block copolymer or a random copolymer.

Although not restricted, in the polymerization procedures, the ratio of the epoxy compound of formula (XX) or the mixture thereof with the oxirane compound of formula (XXII) to the oxygen-containing compound of formula (XXI) is preferably in the range of 5–100 mols per mol of the oxygen-containing compound.

Polymerization may be carried out at a temperature of 60° C.–180° C., preferably 80° C.–150° C.

Chloroformation

The polyoxyalkylene glycol derivative of formula (XXIII) obtained as above or the metal alkoxide thereof prior to be neutralized is subjected to chloroformation at room temperature in the presence of excess phosgene thereby obtaining a chlorine-containing compound of the formula (XXIV)

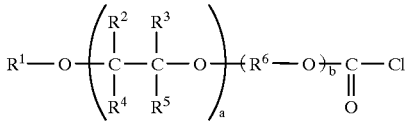

where $R^1$, $R^2$, $R^3$, $R^4$, $R^5$ and $R^6$ and a and b are the same as indicated in the formula (IV).

Carbonic esterification

The chlorine-containing compound of formula (XXIV) obtained as above is reacted with a polyhydric alcohol of the formula (XXVIII)

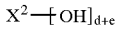

where $X^2$, d and e are the same as indicated in formula (IV) thereby obtaining the inventive oxygen-containing compound. Eligible polyhydric alcohol of formula (XXVIIV) are those identified with regard to group $X^2$ in formula (IV).

The ratio of the polyhydric alcohol of formula (XXVIII) to the chlorine-containing compound of formula (XXIV) is not limited, but preferably more than one mol, more preferably in the range of 1–20 mols per mol of the chlorine-containing compound.

Reaction may be carried out at a temperature of −20° C.–150° C., preferably −10° C.—80° C.

Similar to the preparation of the inventive amine compound, there may be employed introduction of ester group and ester interchange reaction described herein below in places of chloroformation and carbonic esterification.

Introducing of ester group

The polyoxyalkylene glycol derivative of formula (XXIII) or the metal alkoxide thereof prior to be neutralized obtained as above is reacted with an ester of monohalocarboxylic acid of the formula (XXVI)

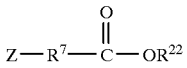

wherein $R^7$ is the same as indicated in the formula (IV), $R^{22}$ is hydrogen or a $C_1$–$C_{30}$ hydrocarbon group and Z is chlorine, bromine or iodine thereby obtaining an ester compound represented by the formula (XXVII)

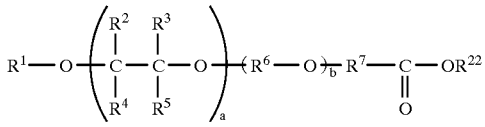

wherein $R^1$, $R^2$, $R^3$, $R^4$, $R^5$, $R^6$ and $R^7$ and a and b are the same as indicated in the formula (IV) and $R^{22}$ is the same as indicated in the formula (XXVI).

Preferred $R^{22}$ examples are hydrogen, a $C_1$–$C_{24}$ straight or branched alkyl group, a $C_2$–$C_{24}$ straight or branched alkenyl group, a $C_5$–$C_{13}$ cycloalkyl or alkylcycloalkyl group, a $C_6$–$C_{18}$ aryl or alkylaryl group or a $C_7$–$C_{19}$ arylalkyl group, such as those already exemplified with regard to the inventive amine compound. Particularly preferred is a $C_1$–$C_{12}$ straight or branched alkyl group and a $C_6$–$C_{12}$ aryl or alkylaryl group, and more preferably a $C_1$–$C_6$ straight or branched alkyl group or phenyl group and a $C_7$–$C_9$ straight or branched alkylaryl group.

Z in the formula (XXVI) is chlorine, bromine and iodine among which chlorine and bromine are particularly preferred.

Although not restricted, the ratio of the ester of monohalocarboxylic acid to the polyoxyalkylene glycol derivative is preferably more than one mol, more preferably 1–8 mols per mol of the polyoxyalkylene glycol derivative.

Reaction temperature is in the range of −20° C.–150° C., preferably −10° C.–80° C.

Ester interchange reaction

The ester compound of formula (XXVII) obtained as above is subjected to ester interchange reaction with the above-mentioned polyhydric alcohol of formula (XXVIII) thereby obtaining the inventive oxygen-containing compound.

Although not restricted, the ratio of the polyhydric alcohol to the ester compound is preferably more than one mol, more preferably 1–20 mols per mol of the ester compound.

Reaction temperature is in the range of 60° C.–200° C., preferably 100° C.–160° C.

Nitrogen-containing compound (C)

Polymerization

In the presence of the same catalyst as used in preparation of the inventive amine compound, a polymerization product in the form of metal alkoxide is produced in accordance with either one of the polymerization methods 1)–4) described with regard to the amine compound. $R^2$, $R^3$, $R^4$ and $R^5$ in formula (XX) representing the epoxy compound used in the polymerization methods 1)–4) and described with regard to the amine compound are the same as indicated in formula (V). $R^1$ in formula (XXI) representing the oxygen-containing compound used in the polymerization methods 1)–4) and described with regard to the amine compound is the same as indicated in formula (V). $R^6$ in formula (XXII) representing the oxirane compound used in the polymerization methods 2)–4) and described with regard to the amine compound is the same as indicated in formula (V). The resulting polymerization product is neutralized with acids such as hydrochloric acid threby obtaining a polyoxyalkylene glycol derivative of the formula (XXIII)

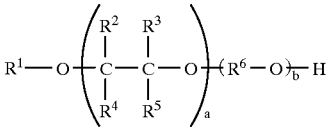

where $R^1$, $R^2$, $R^3$, $R^4$, $R^5$ and $R^6$, and a and b are the same as indicated in the formula (V).

The polyoxyalkylene glycol derivative of formula (XXIII) in which b is not equal to 0 may be a block copolymer or a random copolymer.

Although not restricted, the ratio of the epoxy compound of formula (XX) or the mixture thereof with the oxirane compound of formula (XXII) to the oxygen-containing compound of formula (XXI) is preferably in the range of 5–100 mols per mol of the oxygen-containing compound.

Reaction temperature is in the range of 60° C.–180° C., preferably 80° C.–150° C.

Chloroformation

The polyoxyalkylene glycol derivative of formula (XXIII) obtained as above or the metal alkoxide compound thereof prior to be neutralized is subjected to chloroformation at room temperature in the presence of excess phosgene thereby obtaining a chlorine-containing compound of the formula (XXIV)

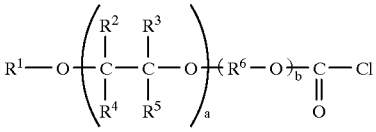

where $R^1$, $R^2$, $R^3$, $R^4$, $R^5$ and $R^6$ and a and b are the same as indicated in the formula (V).

Carbamation

The chlorine-containing compound of formula (XXIV) is reacted with an amine compound of the formula (XXIX)

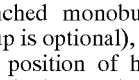

where $X^3$ is the same as that of formula (V) where e is equal to 2.

Preferred examples of amine compound of formula (XXIX) include monomethanoamine, monoethanolamine, mono-n-propanolamine, monoisopropanolamine, straight or branched monobutanolamine (the position of hydroxyl group is optional), straight or branched monopentanolamine (the position of hydroxyl group is optional), straight or branched monohexanolamine (the position of hydroxyl group is optional), 2-(2-aminoethyl)ethanol, $H_2N—CH_2CH_2—NH—CH_2CH_2—OH$, D-glucamine,

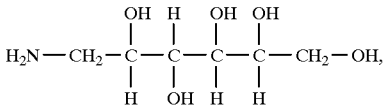

dimethanolamine, diethanolamine, di-n-propanolamine, diisopropanolamine, straight or branched dibutanolamine (the position of hydroxyl group is optional), straight or branched dipentanolamine (the position of hydroxyl group is optional), straight or branched dihexanolamine (the position of hydroxyl group is optional), monohydroxypyrrolidine, monohydroxypyrroline (the position of hydroxyl group is optional), monohydroxypyrrole (the position of hydroxyl group is optional), monohydroxypyrazolidine (the position of hydroxyl group is optional), monohydroxypyrazoline (the position of hydroxyl group is optional), monohydroxypyrazole (the position of hydroxyl group is optional), monohydroxyimidazolidine (the position of hydroxyl group is optional), monohydroxyimidazoline (the position of hydroxyl group is optional), monohydroxyimidazole (the position of hydroxyl group is optional), monohydroxyfuroxane (the position of hydroxyl group is optional), monohydroxypiperidine (the position of hydroxyl group is optional), monohydroxypiperazine (the position of hydroxyl group is optional), monohydroxymorpholine (the position of hydroxyl group is optional), monohydroxyindoline (the position of hydroxyl group is optional), monohydroxyindole (the position of hydroxyl group is optional), monohydroxyisoindole (the position of hydroxyl group is optional), monohydroxypurine (the position of hydroxyl group is optional), monohydroxycarbazole (the position of hydroxyl group is optional), monohydroxy-β-carboline (the position of hydroxyl group is optional), monohydroxyphenoxadine (the position of hydroxyl group is optional), monohydroxyperimidine (the position of hydroxyl group is optional), dihydroxypyrrolidine, dihydroxypyrroline (the position of hydroxyl group is optional), dihydroxypyrrole (the position of hydroxyl group is optional), dihydroxypyrazolidine (the position of hydroxyl group is optional), dihydroxypyrazoline (the position of hydroxyl group is optional), dihydroxypyrazole (the position of hydroxyl group is optional), dihydroxyimidazolidine (the position of hydroxyl group is optional), dihydroxyimidazoline (the position of hydroxyl group is optional), dihydroxyimidazole (the position of hydroxyl group is optional), dihydroxyfuroxane (the position of hydroxyl group is optional), dihydroxypiperidine (the position of hydroxyl group is optional), dihydroxypiperazine (the position of hydroxyl group is optional), dihydroxymorpholine (the position of hydroxyl group is optional), dihydroxyindoline (the position of hydroxyl group is optional), dihydroxyindole (the position of hydroxyl group is optional), dihydroxyisoindole (the position of hydroxyl group is optional), dihydroxypurine (the position of hydroxyl group is optional), dihydroxycarbazole (the position of hydroxyl group is optional), dihydroxy-β-carboline (the position of hydroxyl group is optional), dihydroxyphenoxadine (the position of hydroxyl group is optional) and dihydroxyperimidine (the position of hydroxyl group is optional).

Although not restricted, the amine compound of formula (XXIX) to the chlorine-containing compound of formula (XXIV) is preferably more than one mol, more preferably 1–20 mols per mol of the chlorine-containing compound.

Reaction temperature may be in the range of −20° C.–150° C., preferably −10° C.–80° C.

There may be prepared the inventive nitrogen-containing compound of formula (XVII) by employing the following procedures such as introduction of ester group and formation of amid in places of the above-described chloroformation and carbamation.

Introducing of ester group

The polyoxyalkylene glycol derivative of formula (XXIII) obtained as above or the metal alkoxide compound thereof prior to be neutralized is reacted with an ester of monohalocarboxylic acid of the formula (XXVI)

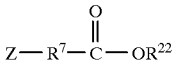

wherein $R^7$ is the same as indicated in the formula (V), $R^{22}$ is hydrogen or a $C_1$–$C_{30}$ hydrocarbon group and Z is chlorine, bromine or iodine thereby obtaining an ester compound represented by the formula (XXVII)

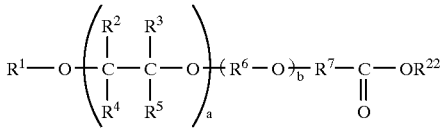

wherein $R^1$, $R^2$, $R^3$, $R^4$, $R^5$, $R^6$ and $R^7$ and a and b are the same as indicated in the formula (V) and $R^{22}$ is the same as indicated in the formula (XXVI).

Preferred $R^{22}$ examples are hydrogen, a $C_1$–$C_{24}$ straight or branched alkyl group, a $C_2$–$C_{24}$ straight or branched alkenyl group, a $C_5$–$C_{13}$ cycloalkyl or alkylcycloalkyl group, a $C_6$–$C_{18}$ aryl or alkylaryl group or a $C_7$–$C_{19}$ arylalkyl group, such as those already exemplified with regard to the inventive amine compound. Particularly preferred is a $C_1$–$C_{12}$ straight or branched alkyl group and a $C_6$–$C_{12}$ aryl or alkylaryl group, and more preferably a $C_1$–$C_6$ straight or branched alkyl group or phenyl group and a $C_7$–$C_9$ straight or branched alkylaryl group.

Z in the formula (XXVI) is chlorine, bromine and iodine among which chlorine and bromine are particularly preferred.

Although not restricted, the ratio of the ester of monohalocarboxylic acid to the polyoxyalkylene glycol derivative is preferably more than one mol, more preferably 1–8 mols per mol of the polyoxyalkylene glycol derivative.

Reaction temperature is in the range of −20° C.–150° C., preferably −10° C.–80° C.

Formation of amide

The ester compound of formula (XXVII) obtained as above is reacted with the aforesaid amine compound of formula (XXIX) thereby obtaining the inventive nitrogen-containing compound of formula (XVII).

Although not restricted, the ratio of the amine compound to the ester compound is preferably more than one mol, more preferably 1–20 mols per mol of the ester compound.

Reaction temperature is in the range of 60° C.–200° C., preferably 100° C.–160° C.

The inventive amine, oxygen-containing or nitrogen-containing compound may be added to fuel in an amount suitable to a particular application, usually in the range of 0.005–10, preferably 0.01–5 percent by mass based on total fuel composition. In the case of being added to internal combustion engine gasolines, the amount of the inventive amine, oxygen-containing or nitrogen-containing compound may be in the range of 0.005–5, preferably 0.01–4, more preferably 0.02–3 percent by mass based on total fuel composition in terms of enhanced detergent effect upon fuel intake systems and combustion chambers.

To provide enhanced detergent capabilities, there may be used one or more suitable other additives including an octane number improver such as alcohol such as methanol and ethanol, ether such as isopropylether, methyl tert-buthylether and methyl tert-amylether and aromatic amine; cetane number improvers such as nitric ester and organic peroxide; surface ignition inhibitors such as organic phosphate and organic phosphate halogenide; antioxidants including phenols such as 2,6-di-tert-butyl-p-cresol and aromatic amines such as phenyl-α-naphthylamine; metal deactivator such as a salicylidenic derivative; metal detergents such as metal sulfonate, metal phenate and metal salicylate; ashless detergent dispersants such as alkenyl succinimide, alkylpolyamine and polyetherpolyamine; antiicing agents such as glycol, glycerin and glycolether; microbicides such as glycolether and boron compounds; combustion improvers such as metal naphthenate, metal sulfonate and alcohol sulfate; cold flow improvers such as ethylene-vinyl acetate copolymer and alkenyl succinamide; corrosion inhibitors such as aliphatic amine and alkenyl succinate; anti-static additives such as anion-based, cation-based or amphoteric surface active agent; and dyes such as an azo-dye. These additives may be added in an amount of less than 0.5, preferably less than 0.2 percent by mass based on total fuel composition.

The invention will be further described by way of the following examples.

SYNTHESIS 1

An autoclave (1 liter) was charged with 13.3 grams (0.06 mol) nonylphenol and 3.37 grams (0.06 mol) potassium hydroxide, followed by purging with nitrogen gas. The admixture was heated to 90° C. and then added with 67.07 grams (0.36 mol) 2-ethylhexylglycidyl ether, 62.73 grams (1.08 mol) propylene oxide and 100 milliliters toluene. Reaction was continued at a temperature of 120° C. for 5 hours. The resulting reaction product was neutralized with hydrochloric acid and extracted with toluene, followed by removal of toluene solvent, thereby providing 120 grams polyoxyalkylene compound. 100 grams (0.04 mol measured by weight average molecular weight) of this polyoxyalkylene compound mixed with 100 milliliters of toluene were added with 8.0 grams (0.081 mol) liquid phosgene at 0° C. and reacted at room temperature while cooling a reflux pipe with dry ice for 12 hours. Excess phosgen was removed and solvent toluene was distilled out, whereupon there was obtained 102 grams chlorine-containing compound.

A mixture of 100 milliliters toluene, 100 milliliters pyridine and 60 grams (0.4 mol) triethanolamine was cooled to 5° C. and added in droplets with 100 grams (0.04 mol measured by weight average molecular weight) of the chlorine-containing compound. The reaction was continued at this temperature for 3 hours. Upon completion of the reaction, unreacted triethanolamine, hydrochloric acid salt of pyridine thus derived and solvent toluene were removed to provide 95 grams amine compound. The resultant amine compound was a dark orange oily liquid having a number average molecular weight of about 2,500. $^{13}$C-NMR) analysis revealed the resultant compound to be a random copolymer having an average structure of the formula

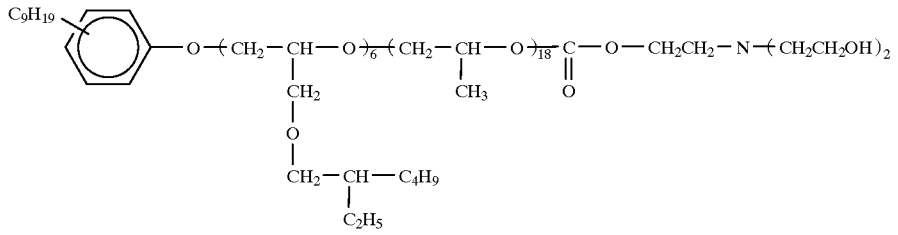

(XXX)

SYNTHESIS 2

An autoclave (1 liter) was charged with 13.3 grams (0.06 mol) nonylphenol and 3.37 grams (0.06 mol) potassium hydroxide, followed by purging with nitrogen gas. The admixture was heated to 90° C. and then added with 67.07 grams (0.36 mol) 2-ethylhexylglycidyl ether, 62.73 grams (1.08 mol) propylene oxide and 100 milliliters toluene. Reaction was continued at a temperature of 120° C. for 5 hours. followed by reacting at a temperature of 5° C. for 5 hours. The resultant reaction product was cooled with ice

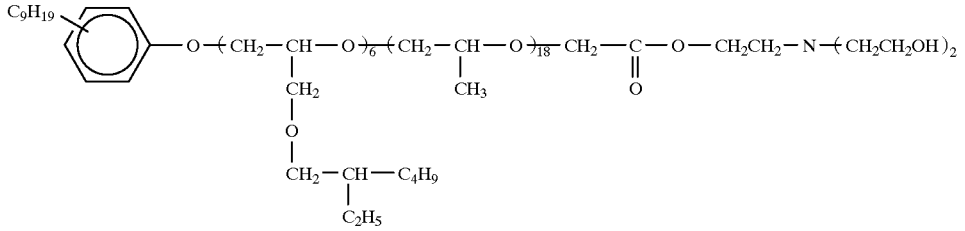

(XXXI)

and added with 13.0 grams (0.12 mol) monochloromethyl acetate. The reaction was continued at a room temperature for 5 hours with stirring. Upon completion of the reaction, excess monochloromethyl acetate, inorganic salt thus derived and solvent toluene were removed thereby obtaining 130 grams ester compound.

A mixture of 10 grams dehydrated p-toluenesulfonic acid, 100 milliliters toluene and 60 grams (0.4 mol) triethanolamine was added with 100 grams (0.04 mol measured by weight average molecular weight ) of the ester compound and heated to 110° C. The admixture was subjected to 10 hours ester interchange reaction while removing the produced methanol. Upon completion of the ester interchange reaction, unreacted triethanol amine, a catalyst p-toluenesulfonic acid and solvent toluene were removed to provide 98 grams amine compound. The resultant amine compound was a dark orange oily liquid having a number average molecular weight of about 2,500. $^{13}$C-NMR analysis revealed the resultant compound to be a random copolymer having an average structure of the formula

SYNTHESIS 3

The procedure of Synthesis 1 was followed except that 4.45 grams (0.06 mol) tert-butanol was used in place of nonylphenol; 48.56 grams (0.48 mol) tert-butylglycidyl ether was used in place of 2-ethylhexylglycidyl ether; the amount of propylene oxide was changed from 62.37 grams (1.08 mol) to 41.82 grams (0.72 mol); and 76.4 grams (0.4 mol) triisopropanolamine was used in place of triethanolamine. There was obtained 91 grams amine compound which was a dark orange oily liquid having a number average molecular weight of about 2,000. $^{13}$C-NMR analysis revealed the resultant compound to be a random polymer having an average structure of the formula (XXXII)

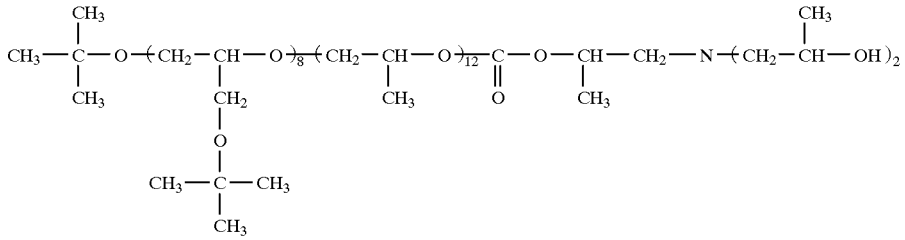

SYNTHESIS 4

The procedure of Synthesis 2 was followed except that 3.60 grams (0.06 mol) isopropanol was used in place of nonylphenol, 108 grams (0.83 mol) tert-butylglycidyl ether was used in place of 2-ethylhexylglycidyl ether, propylene oxide was not used and 76.4 grams (0.4 mol) triisopropanolamine was used as alkanolamine. There was obtained 102 grams amine compound in the form of a dark orange oily liquid having a number average molecular weight of about 2,000. $^{13}$C-NMR analysis revealed the resultant compound to be a polymer having an average structure of the formula by weight average molecular weight) this polyoxyalkylene compound mixed with 100 milliliters of toluene was added with 8.0 grams (0.081 mol) liquid phosgene at 0° C. and reacted at a room temperature for 12 hours while cooling a reflux pipe with dry ice. Excess phosgen was removed and solvent toluene was distilled out, whereupon there was obtained 102 grams chlorine-containing compound.

A mixture of 100 milliliters toluene, 100 milliliters pyridine and 54.4 grams (0.4 mol) pentaerythritol was cooled to 5° C. and added in droplets with 100 grams (0.04 mol measured by weight average molecular weight) of the (XXXIII)

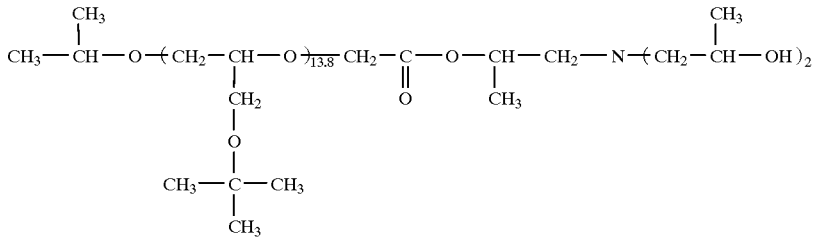

SYNTHESIS 5

An autoclave (1 liter) was charged with 13.3 grams (0.06 mol) nonylphenol and 3.37 grams (0.06 mol) potassium hydroxide, followed by purging with nitrogen gas. The admixture was heated to 90° C. and then added with 67.1 grams (0.36 mol) 2-ethylhexylglycidyl ether, 62.7 grams (1.08 mol) propylene oxide and 100 milliliters toluene. The admixture was reacted at a temperature of 120° C. for 5 hours. The resulting reaction product was neutralized with hydrochloric acid and extracted with toluene, followed by removal of toluene solvent, thereby providing 120 grams polyoxyalkylene compound. 100 grams (0.04 mol measured chlorine-containing compound. The reaction was continued at this temperature for 3 hours. The reaction was further continued at a room temperature for 2 hours. Upon completion of the reaction, unreacted pentaerythritol, hydrochloric acid salt of pyridine thus derived and solvent toluene were removed to provide 95 grams oxygen-containing compound. The resultant oxygen-containing compound was a dark orange oily liquid having a number average molecular weight of about 2,500. $^{13}$C-NMR analysis revealed the resultant compound to be a random copolymer having an average structure of the formula (XXXIV)

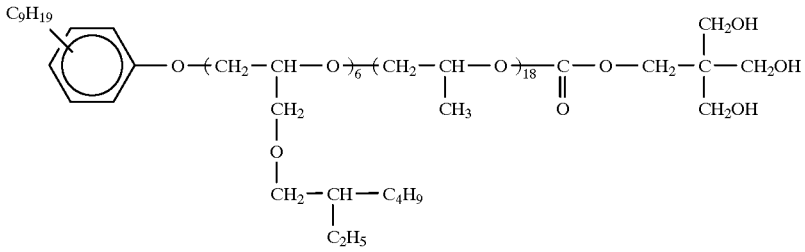

SYNTHESIS 6

An autoclave (1 liter) was charged with 13.3 grams (0.06 mol) nonylphenol and 3.37 grams (0.06 mol) potassium hydroxide, followed by purging with nitrogen gas. The admixture was heated to 90° C. and then added with 67.1 grams (0.36 mol) 2-ethylhexylglycidyl ether, 62.7 grams (1.08 mol) propylene oxide and 100 milliliters toluene. Reaction was continued at 120° C. for 5 hours. Upon completion of the reaction, the reaction system was cooled with ice and added with 13.0 grams (0.12 mol) monochloromethyl acetate at 0° C. Reaction was continued with stirring at a room temperature for 5 hours. Upon completion of the reaction, excess monochloromethyl acetate, inorganic salt thus derived and solvent toluene were removed, whereupon there was obtained 130 grams ester compound. A mixture of 10 grams dehydrated p-toluenesulfonic acid, 100 milliliters toluene and 54.4 grams (0.4 mol) pentaerythritol was added with 100 grams (0.04 mol, measured by weight average molecular weight) of the ester compound and heated to 110° C., followed by 10-hours ester interchange reaction while removing the produced methanol. Upon completion of the reaction, unreacted pentaerythritol, a catalyst p-toluenesulfonic acid and solvent toluene were removed to provide 98 grams oxygen-containing compound. The resultant oxygen-containing compound was a dark orange oily liquid having a number average molecular weight of 2,500. $^{13}$C-NMR analysis revealed the resultant compound to be a random copolymer having an average structure of the formula (XXXVI)

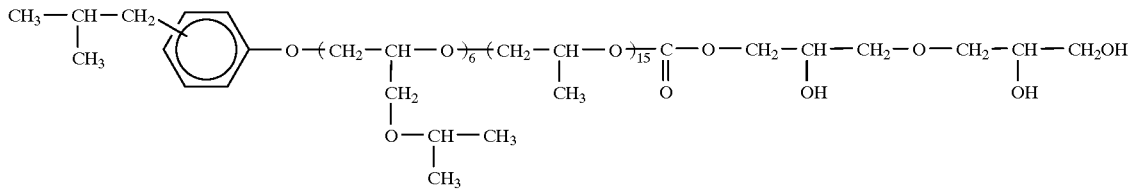

SYNTHESIS 7

The procedure of Synthesis 5 was followed except that 9.00 grams (0.06 mol) isobutylphenol was used in place of nonylphenol; 70.3 grams (0.60 mol) isopropylglycidyl ether was used in place of 2-ethylhexylglycidyl ether; the amount of propylene oxide was changed from 62.7 grams (1.08 mol) to 52.3 grams (0.90 mol); and 66.4 grams (0.40 mol) diglycerol was used in place of pentaerythritol. There was obtained 98 grams oxygen-containing compound which was a dark orange oily liquid having a number average molecular weight of about 1,900. $^{13}$C-NMR analysis revealed the resultant compound to be a random copolymer having an average structure of the formula (XXXV)

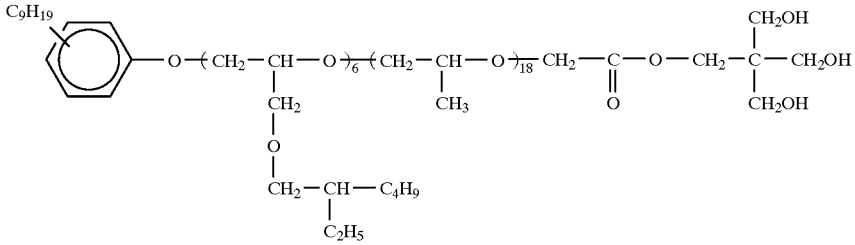

SYNTHESIS 8

The procedure of Synthesis 6 was followed except that 4.45 grams (0.06 mol) tert-butanol was used in place of nonylphenol; 62.5 grams (0.48 mol) tert-butylglycidyl ether was used in place of 2-ethylhexylglycidyl ether; the amount of propylene oxide was changed from 62.7 grams (1.08 mol) to 41.8 grams (0.72 mol); and 72.8 grams (0.40 mol) galactitol was used in place of pentaerythritol. There was obtained 105 grams oxygen-containing compound which was a dark orange oily liquid having a number average molecular weight of about 2,000. $^{13}$C-NMR analysis revealed the resultant compound to be a random copolymer having an average structure of the formula (XXXVII)

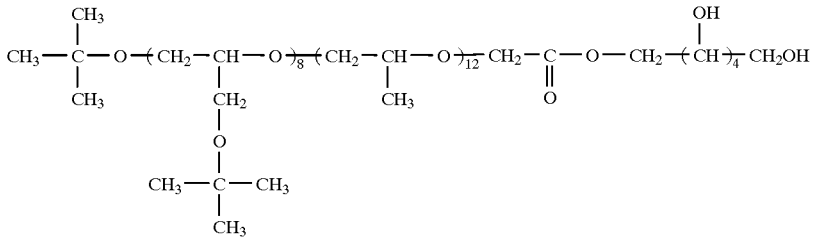

SYNTHESIS 9

The procedure of Synthesis 5 was followed except that 3,60 grams (0.06 mol) isopropanol was used in place of nonylphenol; 108 grams (0.83 mol) tert-butylglycidyl ether was used in place of 2-ethylhexylglycidyl ether; propylene oxide was not used; and 72.0 grams (0.40 mol) D-(+)-glucose was used as polyhydric alcohol. There was obtained 102 grams oxygen-containing compound which was a dark orange oily liquid having a number average molecular weight of about 2,000. $^{13}$C-NMR analysis revealed the resultant compound to be a polymer having an average structure of the formula (XXXVIII)

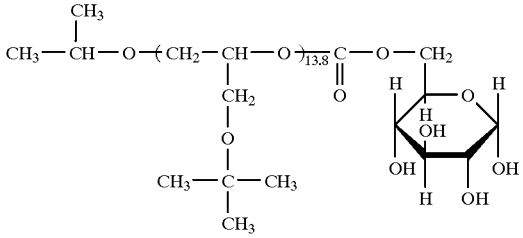

compound mixed with 100 milliliters toluene was added with 8.0 grams (0.081 mol) liquid phosgene at 0° C. and reacted at a room temperature for 12 hours while cooling a reflux pipe with dried ice. Excess phosgen was removed and solvent toluene was distilled out, whereupon there was obtained 102 grams chlorine-containing compound.

The mixture of 100 milliliters toluene and 42.0 grams (0.4 mol) diethanolamine was cooled to 5° C. and added in droplets with 100 grams (0.04 mol measured by weight average molecular weight) the chlorine-containing compound. The reaction was continued at this temperature for 3 hours and then at a room temperature for 2 hours. Upon completion of the reaction, unreacted diethanolamine, hydrochloric acid salt thus derived and solvent toluene were removed to provide 92 grams nitrogen-containing compound. The resultant nitrogen-containing compound was a dark orange oily liquid having a number average molecular weight of about 2,500. $^{13}$C-NMR analysis revealed the resultant compound to be a random copolymer having an average structure of the formula (XXXIX)

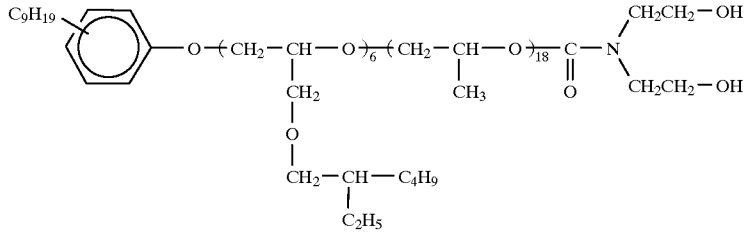

SYNTHESIS 10

An autoclave (1 liter) was charged with 13.3 grams (0.06 mol) nonylphenol and 3.37 grams (0.06 mol) potassium hydroxide, followed by purging with nitrogen gas. The admixture was heated to 90° C. and then added with 67.1 grams (0.36 mol) 2-ethylhexylglycidyl ether, 62.7 grams (1.08 mol) propylene oxide and 100 milliliters toluene. Reaction was continued at a temperature of 120° C. for 5 hours. The resulting reaction product was neutralized with hydrochloric acid and extracted with toluene, followed by distillation of toluene solvent, thereby providing 120 grams polyoxyalkylene compound. 100 grams (0.04 mol measured by weight average molecular weight) this polyoxyalkylene

SYNTHESIS 11

An autoclave (1 liter) was charged with 13.3 grams (0.06 mol) nonylphenol and 3.37 grams (0.06 mol) potassium hydroxide, followed by purging with nitrogen gas. The admixture was heated to 90° C. and then added with 67.1 grams (0.36 mol) 2-ethylhexylglycidyl ether, 62.7 grams (1.08 mol) propylene oxide and 100 milliliters toluene. Reaction was continued at a temperature of 120° C. for 5 hours. Upon completion of the reaction, the reaction system was cooled with ice and added with 13.0 grams (0.12 mol) monochloromethyl acetate at 0° C., followed by another 5 hours reaction at room temperature with stirring. Excess monochloromethyl acetate, inorganic salt thus derived and solvent toluene were removed, whereupon there was obtained 130 grams ester compound. A mixture of 100 milliliters xylene and 42.0 grams (0.4 mol) diethanolamine was heated to 140° C. and then added with 100 grams (0.04 mol measured by weight average molecular weight) of the ester compound. The admixture was reacted at 140° C. for 5 hours. Upon completion of the reaction, unreacted diethanolamine and solvent xylene were removed to provide 96 grams nitrogen-containing compound. The resultant nitrogen-containing compound was a dark orange oily liquid having a number average molecular weight of about 2,500. $^{13}$C-NMR analysis revealed the resultant compound to be a random copolymer having an average structure of the formula

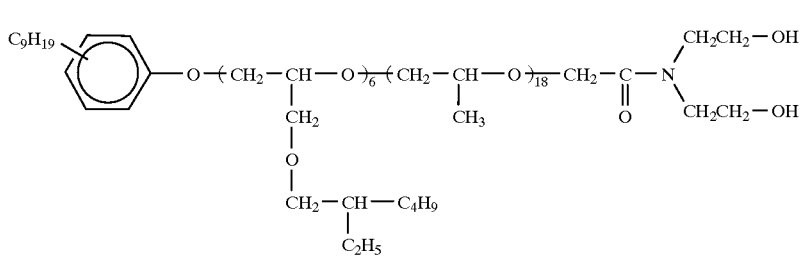

(XL)

SYNTHESIS 12

The procedure of Synthesis 10 was followed except that 9.00 grams (0.06 mol) isobutylphenol was used in place of nonylphenol; 70.3 grams (0.60 mol) isopropylglycidyl ether was used in place of 2-ethylhexylglycidyl ether; the amount of propylene oxide was changed from 62.7 grams (1.08 mol) to 52.3 grams (0.90 mol); and 72.4 grams (0.40 mol) D-glucamine was used in place of diethanolamine. There was obtained 102 grams nitrogen-containing compound which was a dark orange oily liquid having a number average molecular weight of about 1,900. $^{13}$C-NMR analysis revealed the resultant compound to be a random copolymer having an average structure of the formula

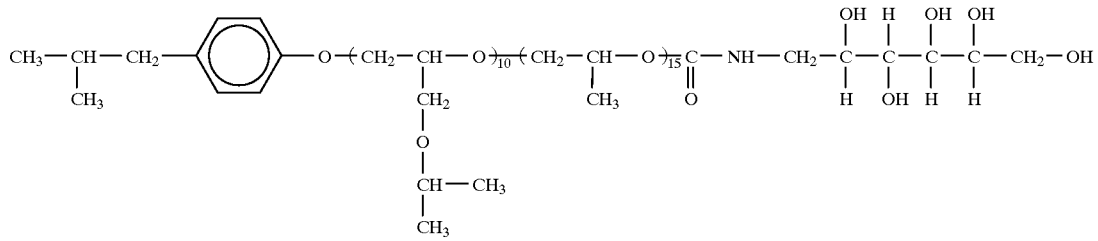

(XLI)

SYNTHESIS 13

The procedure of Synthesis 11 was followed except that 4.45 grams (0.06 mol) tert-butanol was used in place of nonylphenol; 62.5 grams (0.48 mol) tert-butylglycidyl ether was used in place of 2-ethylhexylglycidyl ether; the amount of propylene oxide was changed from 62.7 grams (1.08 mol) to 41.8 grams (0.72 mol); and 41.6 grams (0.40 mol) 2-(2-aminoethylamino)ethanol was used in place of diethanolamine. There was obtained 90 grams nitrogen-containing compound which was a dark orange oily liquid having a number average molecular weight of about 2,000. $^{13}$C-NMR analysis revealed the resultant compound to be a random copolymer having an average structure of the formula (XLII)

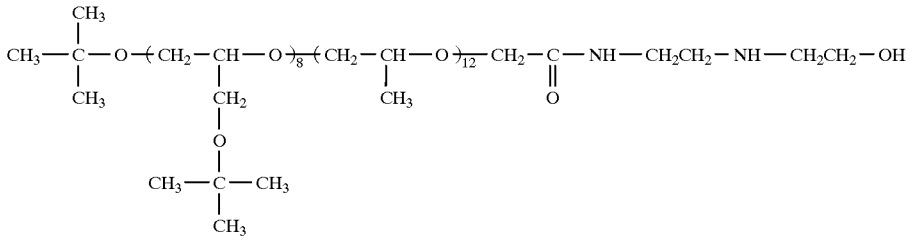

SYNTHESIS 14

The procedure of Synthesis 12 was followed except that 34.8 grams (0.40 mol) 3-pyrrolidinol was used in place of D-glucamine. There was obtained 90 grams nitrogen-containing compound which was a dark orange oily liquid having a number average molecular weight of about 1,900. $^{13}$C-NMR analysis revealed the resultant compound to be a random copolymer having an average structure of the formula (LXIII)

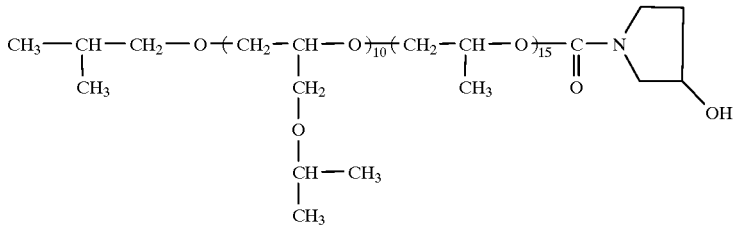

Inventive Examples 1–4 and Comparative Examples 1–3

60 parts by volume of catalytically reformed gasoline, 30 parts by volume of catalytically cracked gasoline and 10 parts by volume of alkylate were mixed to produce a base gasoline of the following properties:

Reid vapor pressure . . . 0.67 kgf/cm$^2$

Specific gravity . . . 0.730

Boiling range . . . 30°–190° C.

Octane number . . . 98.7

The base gasoline was added with each of the amine compounds prepared as in Syntheses 1–4 above to provide fuel compositions (Inventive Examples 1–4) shown in Table 1.

Inventive Examples 5–9 and Comparative Examples 4–6

60 parts by volume of catalytically reformed gasoline, 30 parts by volume of catalytically cracked gasoline and 10 parts by volume of alkylate were mixed to produce a base gasoline of the following properties:

Reid vapor pressure . . . 0.64 kgf/cm$^2$

Specific gravity . . . 0.725

Boiling range . . . 30°–190° C.

Octane number . . . 98.0

The base gasoline was added with each of the oxygen-containing compounds prepared as in Syntheses 5–9 above to provide fuel compositions (Inventive Examples 5–9) shown in Table 2.

Inventive Examples 10–14 and Comparative Examples 7–9

60 parts by volume of catalytically reformed gasoline, 30 parts by volume of catalytically cracked gasoline and 10 parts by volume of alkylate were mixed to produce a base gasoline of the following properties:

Reid vapor pressure . . . 0.64 kgf/cm$^2$

Specific gravity . . . 0.725

Boiling range . . . 30°–190° C.

Octane number . . . 98.0

The base gasoline was added with each of the nitrogen-containing compounds prepared as in Syntheses 10–14 above to provide fuel compositions (Inventive Examples 10–14) shown in Table 3.

Engine Evaluation Test

1. Cleanliness test of fuel intake systems

The above base gasoline free of the inventive amine, oxygen-containing or nitrogen-containing compounds was filled in a passenger car mounted with a new 2,000 ml total displacement engine of injector type. The car was run in the following mode, each cycle of which was repeated for a total of 200 hours.

Run Mode

Idling . . . 1 minute

Engine operating at 1,500 rpm with intake pressure of −200 mmHg . . . 30 minutes Engine operating at 2,700 rpm with intake pressure of −300 mmHg . . . 20 minutes Engine stopped . . . 9 minutes The engine was dismantled to measure the amount of deposits on intake valves. Then, the engine was re-assembled without removing the deposits and operated with each of fuels of the inventive examples according to the above mode repeatedly for 30 hours. The engine was again dismantled to determine deposits on intake valves. Cleanliness of intake systems was evaluated on the basis of differences in the amount of deposits between the first run with the starting gasoline alone and the second run with the inventive fuel compositions.

2. Evaluation test of combustion chamber deposit

A passenger car mounted with a new 2,000 ml total displacement jet engine was filled with each of the inventive fuel compositions and operated at an engine speed of 1,500 rpm with intake pressure of −150 mmHg and at coolant temperature of 50° C. for a total travel time of 96 hours. The engine was thereafter disassembled to measure the amount of deposits in the combustion chamber in comparison with the amount of such deposits resulting from the use of the base gasoline alone.

Similar engine evaluation tests were made with Comparative Examples 1, 4 and 7 where the base gasoline alone was used and with Comparative Examples 2, 3, 5, 6, 8 and 9 where the base gasoline was added with polybutene amine detergents in placenventive amine, oxygen-containing or nitrogen-containing compounds.

From the test results shown in Table 1 through 3 it will be seen that the use of commercially available polybutene amine detergents contributes to cleanliness of fuel intake systems but conversely to increased deposits in the combustion chamber compared to the base gasoline alone. Whereas, the gasoline compositions incorporating the inventive amine, oxygen-containing or nitrogen-containing compounds exhibit significantly enhanced detergent effect upon fuel intake systems, while maintaining levels of combustion chamber deposits substantially comparable to those with the base gasoline alone.

TABLE 1

| | Inventive Examples | | | | Comparative Examples | | |
|---|---|---|---|---|---|---|---|
| | 1 | 2 | 3 | 4 | 1 | 2 | 3 |
| Composition (weight %) | | | | | | | |
| Starting base | [99.96] | [99.96] | [99.96] | [99.96] | [100.00] | [99.96] | [99.96] |
| amide compound | Synthesis 1 [0.04] | Synthesis 2 [0.04] | Synthesis 3 [0.04] | Synthesis 4 [0.04] | — | — | — |
| Other additives | — | — | — | — | — | polybutene amine 1) [0.04] | polybutene amine 2) [0.04] |
| Engine test | | | | | | | |
| varied deposits (mg) in intake systems | −41.2 | −73.7 | −65.3 | −80.8 | +21.8 | −21.3 | −38.1 |
| combustion chamber deposits 3) (mg) | +14.1 | +21.6 | +8.2 | +15.4 | — | +315.2 | +830.7 |

1) Polybutene amine detergent 1 active component: imido (number average molecular weight about 3,000) of polybutenyl succinate and tetraethylene pentamine 2) Polybutene amine detergent 2 active component: polybutenyl tetraethylene pentamine (number average molecular weight about 3,500)

3) Differences compared with base gasoline alone

TABLE 2

| | Inventive Examples | | | | | Comparative Examples | | |
|---|---|---|---|---|---|---|---|---|
| | 5 | 6 | 7 | 8 | 9 | 4 | 5 | 6 |
| Composition (weight %) | | | | | | | | |
| Starting base | [99.96] | [99.96] | [99.96] | [99.96] | [99.96] | [100.00] | [99.96] | [99.96] |
| oxygen-containing compound | Synthesis 5 [0.04] | Synthesis 6 [0.04] | Synthesis 7 [0.04] | Synthesis 8 [0.04] | Synthesis 9 [0.04] | — | — | — |
| Other additives | — | — | — | — | — | — | polybutene amine 1) [0.04] | polybutene amine 2) [0.04] |
| Engine test | | | | | | | | |
| varied deposits (mg) in intake system | −80.2 | −38.6 | −78.1 | −61.3 | −35.9 | +18.5 | −30.8 | −50.1 |
| combustion chamber deposits 3) (mg) | −5.8 | −1.8 | +11.2 | +6.4 | +7.1 | — | +236.4 | +752.2 |

1) Polybutene amine detergent 1 active component: imido (number average molecular weight about 3,000) of polybutenyl succinate and tetraethylene pentamine 2) Polybutene amine detergent 2 active component: polybutenyl tetraethylene pentamine (number average molecular weight about 3,500)

3) Differences compared with base gasoline alone

TABLE 3

| | Inventive Examples | | | | | Comparative Examples | | |
|---|---|---|---|---|---|---|---|---|
| | 10 | 11 | 12 | 13 | 14 | 7 | 8 | 9 |
| Composition (weight %) | | | | | | | | |
| Starting base | [99.96] | [99.96] | [99.96] | [99.96] | [99.96] | [100.00] | [99.96] | [99.96] |
| nitrogen-containing compound | Synthesis 10 [0.04] | Synthesis 11 [0.04] | Synthesis 12 [0.04] | Synthesis 13 [0.04] | Synthesis 14 [0.04] | — | — | — |
| Other additives | — | — | — | — | — | — | polybutene amine 1) [0.04] | polybutene amine 2) [0.04] |
| Engine test | | | | | | | | |
| varied deposits (mg) | −69.5 | −42.2 | −71.3 | −54.9 | −58.4 | +20.4 | −27.2 | −49.5 |
| in intake system | | | | | | | | |
| combustion chamber deposits 3) (mg) | +8.7 | +0.6 | +13.5 | +8.1 | +15.2 | — | +268.1 | +825.4 |

1) Polybutene amine detergent 1
active component: imido (number average molecular weight about 3,000) of polybutenyl succinate and tetraethylene pentamine
2) Polybutene amine detergent 2
active component: polybutenyl tetraethylene pentamine (number average molecular weight about 3,500)
3) Differences compared with base gasoline alone

What is claimed is:

1. A fuel additive which comprises (A) an amine compound being represented by (I)

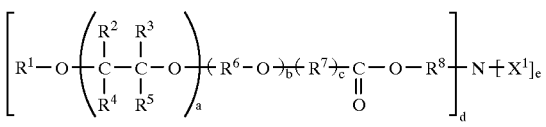

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of formula (II) below, provided that at least one of $R^2$, $R^3$, $R^4$ and $R^5$ is a group of formula (II), $R^6$ is a $C_2$–$C_6$ alkylene group, $R^7$ and $R^8$ each are a $C_1$–$C_6$ alkylene group, a is an integer of between 1 to 100, b is an integer of between 0 to 100, the sum of a and b being equal to between 1 to 200, c is an integer of 0 or 1, d and e each are an integer of 1 or 2, the sum of d and e being equal to 3, and if e is equal to 1, $X^1$ is a group of formula (III) below and if e is equal to 2, one of $X^1$ is a group of formula (III) below and the other is a $C_1$–$C_{30}$ hydrocarbon group or a group of formula (III), said formula (II) being represented by (II)

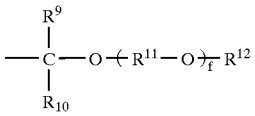

wherein $R^9$ and $R^{10}$ each are hydrogen, a $C_1$–$C_{10}$ hydrocarbon group or a $C_2$–$C_{10}$ alkoxyalkyl group, $R^{11}$ is a $C_2$–$C_6$ alkylene group or a $C_4$–$C^{10}$ alkylene group having an alkoxyalkyl substituent, $R^{12}$ is a hydrogen or a $C_1$–$C_{30}$ hydrocarbon group, and f is an integer of between 0 to 50;

said formula (III) being represented by $$—R^{13}—OH \quad \text{(III)}$$

wherein $R^{13}$ is a $C_1$–$C_6$ alkylene group.

2. A fuel additive according to claim 1 wherein said amine compound (A) is represented by the formula (I)

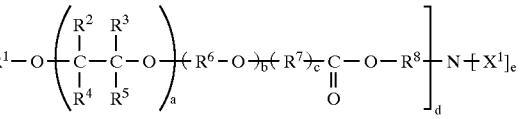

wherein $R^1$ is a $C_1$–$C_{12}$ straight or branched alkyl group or a $C_6$–$C_{18}$ aryl or alkylaryl group; $R^2$, $R^3$, $R^4$ and $R^5$ each are selected from the group consisting of hydrogen, a $C_1$–$C_6$ alkyl group and a group of formula (II) below, with the proviso that one or two of $R^2$, $R^3$, $R^4$ and $R^5$ are groups of formula (II); $R^6$ is a $C_2$–$C_4$ alkylene group; $R^7$ and $R^8$ each are a $C_1$–$C_4$ alkylene group; a is an integer of between 1 and 100, b is an integer of between 0 and 100, the sum of a and b being an integer of between 1 and 200, c is an integer of 0 or 1, d is an integer of between 1 and 2, e is an integer of between 1 and 2, the sum of d and e being equal to 3; and one of $X^1$ is a group of formula (III) below or a $C_1$–$C_{30}$ hydrocarbon and the other is a group of formula (III) if d is equal to 1 and e is equal to 2, and $X^1$ is a group of formula (III) if d is equal to 2 and e is equal to 1;

said formula (II) is represented by (II)

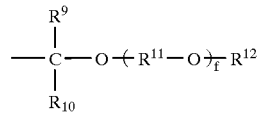

wherein $R^9$ and $R^{10}$ each are hydrogen, a $C_1$–$C_6$ alkyl group or a $C_2$–$C_6$ alkoxyalkyl group, $R^{11}$ is a $C_2$–$C_6$ alkylene group or a $C_4$–$C_8$ alkoxyalkyl-substituted ethylene group; $R^{12}$ is a $C_1$–$C_{24}$ alkyl group; f is an integer of between 0 and 30;

said formula (III) is represented by $$—R^{13}—OH \quad \text{(III)}$$

wherein $R^{13}$ is a $C_1$–$C_4$ alkylene group.

3. A fuel additive according to claim 2 wherein said amine compound (A) is represented by the formula (I)

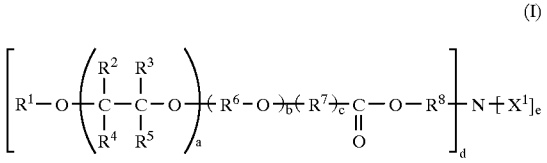

wherein $R^1$ is a $C_1$–$C_6$ alkyl or phenyl group or a $C_7$–$C_{15}$ alkylaryl group; one of $R^2$, $R^3$, $R^4$ and $R^5$ is a group of formula (II) below while the remaining three each are hydrogen or a $C_1$–$C_3$ alkyl group; $R^6$ is a $C_2$–$C_4$ alkylene group selected from the group consisting of ethylene, 1-methylethylene, 2-methylethylene, trimethylene, 1-ethylethylene, 2-ethylethylene, 1,2-dimethylethylene, 2,2-dimethylethylene, 1-methyltrimethylene, 2-methyltrimethylene, 3-methyltrimethylene and tetramethylene; $R^7$ and $R^8$ each are a $C_1$–$C_3$ alkylene group selected from the group consisting of methylene, ethylene, 1-methylethylene, 2-methylethylene and trimethylene; a is an integer of between 2 and 50 and b is an integer of between 0 and 50, the sum of a and b being equal to between 2 and 100; c is an integer of 0 or 1, d is equal to 1 and e is equal 2; and two $X^1$ are groups of formula (III); said formula (II) being represented by (II)

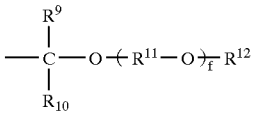

wherein $R^9$ and $R^{10}$ each are hydrogen or a $C_1$–$C_3$ alkyl group; $R^{11}$ is a $C_2$–$C_4$ alkylene group; $R^{12}$ is a $C_1$–$C_{12}$ alkyl group; f is an integer of between 0 and 20;

said formula (III) being represented by $$—R^{13}—OH \quad \text{(III)}$$

wherein $R^{13}$ is a $C_1$–$C_3$ alkylene group.

4. A fuel composition which comprises a base gasoline blended with (A) an amine compound being represented by (I)

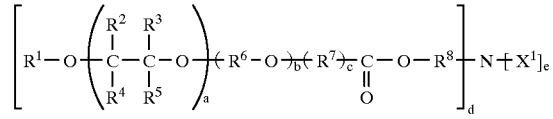

wherein $R^1$ is hydrogen or a $C_1$–$C_{30}$ hydrocarbon group, $R^2$, $R^3$, $R^4$ and $R^5$ each are selected from the group consisting of hydrogen, a $C_1$–$C_{10}$ hydrocarbon group and a group of formula (II) below, provided that at least one of $R^2$, $R^3$, $R^4$ and $R^5$ is a group of formula (II), $R^6$ is a $C_2$–$C_6$ alkylene group, $R^7$ and $R^8$ each are a $C_1$–$C_6$ alkylene group, a is an integer of between 1 to 100, b is an integer of between 0 to 100, the sum of a and b being equal to between 1 to 200, c is an integer of 0 or 1, d and e each are an integer of 1 or 2, the sum of d and e being equal to 3, if e is equal to 1, $X^1$ is a group of formula (III) below and if e is equal to 2, one of $X^1$ is a group of formula (III) below and the other is a $C_1$–$C_{30}$ hydrocarbon group or a group of formula (III), said formula (II) being represented by (II)

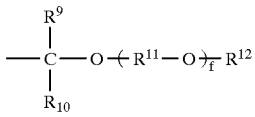

wherein $R^9$ and $R^{10}$ each are hydrogen, a $C_1$–$C_{10}$ hydrocarbon group or a $C_2$–$C_{10}$ alkoxyalkyl group, $R^{11}$ is a $C_2$–$C_6$ alkylene group or a $C_4$–$C_{10}$ alkylene group having an alkoxyalkyl substituent, $R^{12}$ is a hydrogen or a $C_1$–$C_{30}$ hydrocarbon group, and f is an integer of between 0 to 50;

said formula (III) being represented by $$—R^{13}—OH \quad \text{(III)}$$

wherein $R^{13}$ is a $C_1$–$C_6$ alkylene group.

5. A fuel composition according to claim 4 wherein said amine compound (A) is added in an amount in the range of 0.005–5 percent by mass based on total composition.

* * * * *